US011491755B2

(12) United States Patent
Walsh

(10) Patent No.: US 11,491,755 B2
(45) Date of Patent: Nov. 8, 2022

(54) METHOD AND SYSTEM FOR FORMING PACKAGES

(71) Applicant: Graphic Packaging International, LLC, Atlanta, GA (US)

(72) Inventor: Joseph C. Walsh, Boulder, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 103 days.

(21) Appl. No.: 16/504,730

(22) Filed: Jul. 8, 2019

(65) Prior Publication Data

US 2020/0009818 A1 Jan. 9, 2020

Related U.S. Application Data

(60) Provisional application No. 62/695,375, filed on Jul. 9, 2018.

(51) Int. Cl.
*B31B 50/04* (2017.01)
*B31B 70/00* (2017.01)
(Continued)

(52) U.S. Cl.
CPC ..... *B31B 50/042* (2017.08); *B31B 50/16* (2017.08); *B31B 50/624* (2017.08);
(Continued)

(58) Field of Classification Search
CPC ..... B31B 50/04; B31B 50/042; B31B 50/16; B31B 50/62; B31B 70/00; B31B 70/008;
(Continued)

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

Notice of Reasons for Refusal for Japanese Application No. 2018-501343 dated Oct. 28, 2019, with English translation.
(Continued)

*Primary Examiner* — Andrew M Tecco
*Assistant Examiner* — Jacob A Smith
(74) *Attorney, Agent, or Firm* — Womble Bond Dickinson (US) LLP

(57) ABSTRACT

A method of forming reinforced packages. The method can comprise moving a blank in a machine direction on a blank conveyor, and forming a tubular web while moving a first web of material and a second web of material in the machine direction. The forming the tubular web can comprise at least partially sealing at least a portion of the first web and the second web together to form a sealed margin of the tubular web. The method further can comprise forming a liner by cutting the tubular web, forming an attached blank by attaching the liner to the blank, and moving the attached blank in the machine direction on the blank conveyor.

33 Claims, 13 Drawing Sheets

(51) Int. Cl.

| | |
|---|---|
| ***B31B 70/26*** | (2017.01) |
| ***B31B 50/62*** | (2017.01) |
| ***B31B 50/16*** | (2017.01) |
| ***B31B 70/64*** | (2017.01) |
| ***B65D 5/56*** | (2006.01) |

(52) U.S. Cl.
CPC ..... *B31B 70/008* (2017.08); *B31B 70/26* (2017.08); *B31B 70/64* (2017.08); *B65D 5/56* (2013.01)

(58) Field of Classification Search
CPC ..... B31B 70/26; B31B 70/64; B31B 2120/40; B31B 2120/402; B31B 2120/407; B31B 2120/408; B65D 5/4608; B65D 5/542; B65D 5/56; B65D 5/606
USPC ..... 493/52
See application file for complete search history.

(56) References Cited

U.S. PATENT DOCUMENTS

| | | | |
|---|---|---|---|
| 1,664,111 | A | 3/1928 | Johnson |
| 2,092,858 | A | 9/1937 | Richard |
| 2,095,910 | A | 10/1937 | Bergstein |
| 2,099,257 | A | 11/1937 | Bergstein |
| 2,107,946 | A | 2/1938 | Inman |
| 2,114,625 | A | 4/1938 | Bergstein |
| 2,134,057 | A | 10/1938 | Potdevin |
| 2,132,966 | A | 11/1938 | O'Brien |
| 2,166,388 | A | 7/1939 | Bergstein |
| 2,197,113 | A | 4/1940 | Piazze |
| 2,250,249 | A | 7/1941 | Bergstein |
| 2,273,470 | A | 2/1942 | Gardner |
| 2,282,207 | A | 5/1942 | Palmer |
| 2,286,465 | A | 6/1942 | Erlin |
| RE23,096 | E | 4/1949 | Mullinix |
| 2,502,117 | A | 3/1950 | Anderson |
| 2,553,923 | A | 5/1951 | Lambert |
| 2,758,520 | A | 8/1956 | Hepworth |
| 2,799,211 | A | 7/1957 | Zerlin |
| 2,835,435 | A | 5/1958 | Mullinix |
| 2,870,023 | A | 1/1959 | Vogt |
| 2,913,161 | A | 11/1959 | Travis |
| 2,987,402 | A | 6/1961 | Dold |
| 3,104,596 | A | 9/1963 | Bergstein |
| 3,105,417 | A | 10/1963 | Hammer |
| 3,142,231 | A | 7/1964 | Christensson |
| 3,142,430 | A | 7/1964 | Meyers |
| 3,153,991 | A | 10/1964 | Goodrich |
| 3,194,471 | A | 7/1965 | Murphy |
| 3,218,961 | A | 11/1965 | Kraft et al. |
| 3,240,419 | A | 3/1966 | Spiering et al. |
| 3,249,286 | A | 5/1966 | Palmer |
| 3,250,454 | A | 5/1966 | Steiger |
| 3,272,423 | A | 9/1966 | Bjarno |
| 3,324,998 | A | 6/1967 | Farquhar |
| 3,336,846 | A | 8/1967 | Berghgracht |
| 3,357,631 | A | 12/1967 | Aid et al. |
| 3,395,623 | A | 8/1968 | Baker |
| 3,399,818 | A | 9/1968 | Stegner |
| 3,412,925 | A | 11/1968 | Booth |
| 3,428,235 | A | 2/1969 | Randazzo |
| 3,459,357 | A | 8/1969 | Egger et al. |
| 3,461,642 | A | 8/1969 | Langen et al. |
| 3,482,758 | A | 12/1969 | Pierre |
| 3,515,333 | A | 6/1970 | Kotkas et al. |
| 3,543,469 | A | 12/1970 | Ullman |
| 3,552,640 | A | 1/1971 | Young |
| 3,554,434 | A | 1/1971 | Anderson |
| 3,570,751 | A | 3/1971 | Trewella |
| 3,575,409 | A | 4/1971 | Calvert |
| 3,576,290 | A | 4/1971 | Marchisen |
| 3,616,027 | A | 10/1971 | Honsel |
| 3,627,541 | A | 12/1971 | Farquhar |
| 3,637,130 | A | 1/1972 | Farquhar |
| 3,659,777 | A | 5/1972 | Kanada et al. |
| 3,739,545 | A | 6/1973 | Lattke |
| 3,800,677 | A | 4/1974 | Jones et al. |
| 3,878,771 | A | 4/1975 | Malcolm |
| RE28,554 | E | 9/1975 | Curler et al. |
| 3,945,870 | A | 3/1976 | Johnsen |
| 3,959,950 | A | 6/1976 | Fukuda |
| 3,964,669 | A | 6/1976 | Sontag et al. |
| 3,981,494 | A | 9/1976 | Prestegaard |
| 4,011,983 | A | 3/1977 | Greene |
| 4,034,658 | A | 7/1977 | Sherman |
| 4,082,216 | A | 4/1978 | Clarke |
| 4,164,171 | A | 8/1979 | Meyers et al. |
| 4,170,928 | A | 10/1979 | Beasley |
| 4,196,035 | A | 4/1980 | Reil |
| 4,228,945 | A | 10/1980 | Wysocki |
| 4,244,281 | A | 1/1981 | Kauffman et al. |
| 4,267,955 | A | 5/1981 | Struble |
| 4,284,205 | A | 8/1981 | Hirata |
| 4,312,451 | A | 1/1982 | Forbes, Jr. |
| 4,313,542 | A | 2/1982 | Roberts et al. |
| 4,331,434 | A | 5/1982 | Buschor |
| 4,359,214 | A | 11/1982 | Eldridge |
| 4,398,636 | A | 8/1983 | Baxter |
| 4,413,464 | A | 11/1983 | Larsson et al. |
| 4,457,483 | A | 7/1984 | Gagne |
| 4,477,014 | A | 10/1984 | Brandenburger |
| 4,478,351 | A | 10/1984 | Homma |
| 4,484,683 | A | 11/1984 | Werner, Jr. |
| 4,490,960 | A | 1/1985 | Klemesrud |
| 4,494,785 | A | 1/1985 | Song |
| 4,520,615 | A | 6/1985 | Engler |
| 4,575,000 | A | 3/1986 | Gordon et al. |
| 4,577,746 | A | 3/1986 | Tokuno et al. |
| 4,578,929 | A | 4/1986 | Tisma |
| 4,582,315 | A | 4/1986 | Scarpa et al. |
| 4,600,346 | A | 7/1986 | Podosek |
| 4,605,464 | A | 8/1986 | Slevin |
| 4,608,259 | A | 8/1986 | Cortopassi |
| 4,627,223 | A | 12/1986 | Janhonen |
| 4,726,170 | A | 2/1988 | Sawa et al. |
| 4,747,703 | A | 5/1988 | Cazes |
| 4,754,914 | A | 7/1988 | Wischusen, III |
| 4,775,771 | A | 10/1988 | Pawlowski |
| 4,785,696 | A | 11/1988 | Martiny |
| 4,793,117 | A | 12/1988 | Raudat et al. |
| 4,802,664 | A | 2/1989 | Larsen |
| 4,854,983 | A | 8/1989 | Bryniarski et al. |
| 4,865,921 | A | 9/1989 | Hollenberg |
| 4,881,934 | A | 11/1989 | Harston et al. |
| 4,890,439 | A | 1/1990 | Smart |
| 4,919,785 | A | 4/1990 | Willey et al. |
| 4,930,639 | A | 6/1990 | Rigby |
| 4,936,935 | A | 6/1990 | Beckett |
| 4,940,200 | A | 7/1990 | Sawyer |
| 4,963,424 | A | 10/1990 | Beckett |
| 4,986,522 | A | 1/1991 | Paulson |
| 4,995,217 | A | 2/1991 | Francis, Jr. |
| 5,014,582 | A | 5/1991 | Teik |
| 5,019,029 | A | 5/1991 | Calvert |
| 5,028,147 | A | 7/1991 | Graham |
| 5,034,234 | A | 7/1991 | Andreas et al. |
| 5,071,062 | A | 12/1991 | Bradley et al. |
| 5,078,273 | A | 1/1992 | Kuchenbecker |
| 5,080,643 | A | 1/1992 | Mitchell et al. |
| 5,093,364 | A | 3/1992 | Richards |
| 5,096,723 | A | 3/1992 | Turpin |
| 5,097,651 | A | 3/1992 | Decottignies et al. |
| 5,102,385 | A | 4/1992 | Calvert |
| 5,102,485 | A | 4/1992 | Keeler et al. |
| 5,108,355 | A | 4/1992 | Walsh |
| 5,117,078 | A | 5/1992 | Beckett |
| 5,132,124 | A | 7/1992 | Tamaki et al. |
| 5,154,041 | A | 10/1992 | Schneider |
| 5,175,404 | A | 12/1992 | Andreas et al. |
| 5,176,612 | A | 1/1993 | Calvert et al. |
| 5,199,792 | A | 4/1993 | Roosa |
| 5,205,651 | A | 4/1993 | Decottignies et al. |

(56) References Cited

U.S. PATENT DOCUMENTS 5,207,629 A 5/1993 Walsh
5,213,902 A 5/1993 Beckett
5,221,419 A 6/1993 Beckett
5,224,919 A 7/1993 Walsh
5,242,365 A 9/1993 Counts
5,254,071 A 10/1993 Laroche
5,260,537 A 11/1993 Beckett
5,266,386 A 11/1993 Beckett
5,282,349 A 2/1994 Siegel
5,282,528 A 2/1994 Hudson
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,632,368 A 5/1997 Moncrief
5,653,671 A 8/1997 Reuteler
5,657,610 A 8/1997 Dietrich et al.
5,662,577 A 9/1997 Reuteler
5,672,407 A 9/1997 Beckett
5,688,427 A 11/1997 Gallo, Jr.
5,733,236 A 3/1998 De Smedt
5,746,871 A 5/1998 Walsh
5,759,422 A 6/1998 Schmelzer
5,772,569 A 6/1998 Janhonen
5,800,724 A 9/1998 Habeger
5,845,769 A 12/1998 Yeager
5,876,319 A 3/1999 Holton
5,921,681 A 7/1999 Money
5,938,110 A 8/1999 Bernstein
5,964,161 A 10/1999 Conway
5,997,458 A 12/1999 Guttinger et al.
6,050,063 A 4/2000 Ford et al.
6,063,415 A 5/2000 Walters
6,073,423 A 6/2000 House
6,082,613 A 7/2000 Mikulski et al.
6,114,679 A 9/2000 Lai
6,132,351 A 10/2000 Lotto et al.
6,139,662 A 10/2000 Forman
6,146,028 A 11/2000 Preszler
6,150,646 A 11/2000 Lai et al.
6,204,492 B1 3/2001 Zeng et al.
6,206,279 B1 3/2001 Countee
6,213,286 B1 4/2001 Hunter et al.
6,234,384 B1 5/2001 Capy et al.
6,251,451 B1 6/2001 Zeng
6,254,519 B1 7/2001 Toshima
6,311,457 B1 11/2001 May et al.
6,312,742 B1 11/2001 Wood et al.
6,319,182 B1 11/2001 Schneider
6,332,488 B1 12/2001 Walsh
6,335,042 B1 1/2002 Money
6,349,874 B1 2/2002 Hill
6,360,941 B1 3/2002 Larsson
6,398,010 B1 6/2002 Fangmeier
6,401,927 B1 6/2002 Sorensen et al.
6,414,290 B1 7/2002 Cole
6,425,847 B1 7/2002 Broenstrup
6,431,365 B1 8/2002 Money
6,433,322 B2 8/2002 Zeng et al.
6,455,827 B2 9/2002 Zeng
6,490,843 B1 12/2002 May
6,494,619 B1 12/2002 Sulpizio
6,509,052 B1 1/2003 Benham et al.
6,550,608 B1 4/2003 Brown et al.
6,552,315 B2 4/2003 Zeng et al.
6,635,139 B2 10/2003 Bohn
6,637,646 B1 * 10/2003 Muise ..... B65D 5/606 229/117.01
6,657,165 B1 12/2003 Makutonin
6,676,583 B2 1/2004 Walsh
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,854,639 B2 2/2005 Walsh
6,869,387 B2 3/2005 Post et al.
6,915,829 B2 7/2005 Popp
6,948,293 B1 9/2005 Eckermann
6,986,920 B2 1/2006 Forman et al.
6,993,889 B2 2/2006 Ford et al.
7,019,271 B2 3/2006 Wnek et al.
7,070,551 B2 7/2006 Lasson
7,143,930 B2 12/2006 Money et al.
7,414,230 B2 8/2008 Fitzwater
7,445,590 B2 11/2008 Selle et al.
7,461,838 B2 12/2008 Hendricks et al.
7,473,875 B2 1/2009 Fitzwater
7,509,789 B2 3/2009 Scholtes et al.
7,510,515 B2 3/2009 Ichikawa
7,604,155 B2 10/2009 Bossel et al.
7,667,167 B2 2/2010 Fitzwater
7,695,421 B2 4/2010 Ford
7,699,214 B2 4/2010 Mestre et al.
7,794,147 B2 9/2010 Perelman
7,819,583 B2 10/2010 Walker et al.
7,837,606 B2 11/2010 Tetenborg et al.
7,893,389 B2 2/2011 Fitzwater
7,913,897 B2 3/2011 Manaige
7,935,041 B2 5/2011 Graham et al.
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,024,910 B2 9/2011 Graham et al.
8,025,618 B2 9/2011 Walsh et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,323,165 B2 12/2012 Atoui
8,403,819 B2 3/2013 Zoeckler
8,403,820 B2 3/2013 Zoeckler
8,468,782 B2 6/2013 Michalsky et al.
8,474,163 B2 7/2013 Rubin
8,479,972 B2 7/2013 Craft
8,500,330 B2 8/2013 Nomura et al.
8,579,780 B2 11/2013 Senbo
8,672,214 B2 3/2014 Manaige
8,727,204 B2 5/2014 Burke
8,826,959 B2 9/2014 Files et al.
8,870,519 B2 10/2014 Karst
8,961,380 B2 2/2015 Langen
9,050,770 B1 6/2015 Russell
9,073,659 B2 7/2015 Smith
9,108,761 B2 8/2015 Fitzwater et al.
9,113,648 B2 8/2015 Burke
9,156,579 B2 10/2015 Pinkstone
9,156,582 B2 10/2015 Walsh et al.
9,238,343 B2 1/2016 Selle et al.
9,346,234 B2 5/2016 Hajek et al.
9,346,582 B2 5/2016 Pinkstone
9,463,896 B2 10/2016 Fitzwater
9,522,499 B2 12/2016 Files et al.

(56) References Cited

U.S. PATENT DOCUMENTS

| | | | | |
|---|---|---|---|---|
| 9,663,320 | B2 | 5/2017 | Wittmann et al. | |
| 9,758,275 | B2 | 9/2017 | Fitzwater et al. | |
| 10,023,349 | B2 | 7/2018 | Fitzwater | |
| 10,173,805 | B2 | 1/2019 | Waddington | |
| 10,737,824 | B2 | 8/2020 | Fitzwater | |
| 2002/0041067 | A1 | 4/2002 | Muller | |
| 2002/0148882 | A1 | 10/2002 | Bowers | |
| 2003/0002755 | A1 | 1/2003 | Kim et al. | |
| 2003/0080120 | A1 | 5/2003 | Whitmore et al. | |
| 2003/0144121 | A1 | 7/2003 | Walsh | |
| 2003/0185948 | A1 | 10/2003 | Garwood | |
| 2003/0197051 | A1 | 10/2003 | Muise | |
| 2003/0206997 | A1 | 11/2003 | Winkelman et al. | |
| 2004/0004111 | A1 | 1/2004 | Cardinale | |
| 2004/0016216 | A1 | 1/2004 | Romagnoli | |
| 2004/0074947 | A1 | 4/2004 | Hillebrand | |
| 2004/0101605 | A1 | 5/2004 | Sigel | |
| 2004/0206049 | A1 | 10/2004 | Hiramoto et al. | |
| 2005/0014623 | A1 | 1/2005 | Van De Kruys | |
| 2005/0124478 | A1 | 6/2005 | Scholtes et al. | |
| 2005/0272583 | A1 | 12/2005 | Totani | |
| 2005/0284865 | A1 | 12/2005 | Fogle et al. | |
| 2006/0009339 | A1 | 1/2006 | Sleight et al. | |
| 2006/0027303 | A1 | 2/2006 | Hunter | |
| 2006/0037290 | A1 | 2/2006 | Smith | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0067225 | A1 | 3/2008 | Moore | |
| 2008/0227612 | A1 | 9/2008 | Harston | |
| 2008/0308614 | A1 | 12/2008 | Fitzwater | |
| 2009/0005228 | A1 | 1/2009 | Goto et al. | |
| 2009/0039077 | A1 | 2/2009 | Fitzwater | |
| 2009/0139187 | A1 | 6/2009 | Wood | |
| 2009/0193757 | A1 | 8/2009 | Roesler | |
| 2009/0197750 | A1 | 8/2009 | Beckmann | |
| 2009/0214142 | A1 | 8/2009 | Bossel et al. | |
| 2009/0252440 | A1 | 10/2009 | Biese | |
| 2010/0022375 | A1 | 1/2010 | Colla | |
| 2010/0046861 | A1 | 2/2010 | Wilcoxen | |
| 2010/0066007 | A1 | 3/2010 | Muller | |
| 2010/0263332 | A1 | 10/2010 | Files et al. | |
| 2010/0284634 | A1* | 11/2010 | Hadley | B65D 81/3858 383/211 |
| 2011/0017812 | A1 | 1/2011 | Belko et al. | |
| 2011/0019942 | A1 | 1/2011 | Piraneo | |
| 2011/0052106 | A1 | 3/2011 | Holmes et al. | |
| 2011/0053746 | A1 | 3/2011 | Desertot et al. | |
| 2011/0255809 | A1 | 10/2011 | Tucker et al. | |
| 2011/0297680 | A1 | 12/2011 | Howell et al. | |
| 2012/0224794 | A1 | 9/2012 | Veder | |
| 2012/0231941 | A1 | 9/2012 | Senbo | |
| 2012/0267425 | A1 | 10/2012 | Whiteside | |
| 2012/0297736 | A1 | 11/2012 | Ausnit | |
| 2013/0068653 | A1 | 3/2013 | Lipinski | |
| 2013/0202229 | A1 | 8/2013 | Broering | |
| 2014/0016882 | A1 | 1/2014 | Fitzwater | |
| 2014/0045666 | A1* | 2/2014 | Endou | B65H 23/038 493/186 |
| 2014/0113787 | A1 | 4/2014 | Aganovic et al. | |
| 2014/0128235 | A1* | 5/2014 | Walsh, Jr. | B31B 70/16 493/264 |
| 2014/0270592 | A1 | 9/2014 | Walsh | |
| 2015/0048152 | A1 | 2/2015 | Vistrom | |
| 2015/0072848 | A1 | 3/2015 | Graham et al. | |
| 2015/0083789 | A1 | 3/2015 | Fitzwater et al. | |
| 2015/0367974 | A1* | 12/2015 | Sytema | B65B 57/12 53/461 |
| 2016/0107814 | A1 | 4/2016 | Fitzwater | |
| 2016/0185065 | A1* | 6/2016 | Sytema | B31B 50/52 493/180 |
| 2016/0318274 | A1 | 11/2016 | Walsh | |
| 2016/0318275 | A1 | 11/2016 | Walsh | |
| 2016/0368205 | A1 | 12/2016 | Wieduwilt et al. | |
| 2017/0015079 | A1* | 1/2017 | Walsh | B31B 70/008 |
| 2018/0086018 | A1* | 3/2018 | Fukuda | B31B 50/04 |
| 2018/0339480 | A1* | 11/2018 | Yanagisawa | B31B 70/16 |
| 2019/0143625 | A1* | 5/2019 | Lau | B31B 50/102 493/34 |

FOREIGN PATENT DOCUMENTS

| | | | |
|---|---|---|---|
| CN | 103434294 | A | 12/2003 |
| CN | 101102887 | A | 1/2008 |
| DE | 1 060 313 | | 6/1959 |
| DE | 11 47 379 | B | 4/1963 |
| DE | 18 10 965 | A1 | 10/1970 |
| DE | 203 00 817 | | 4/2003 |
| EP | 0 729 828 | A2 | 9/1996 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 353 843 | B1 | 4/2005 |
| EP | 1 798 159 | A1 | 6/2007 |
| EP | 1 964 785 | | 9/2008 |
| EP | 2 487 027 | | 8/2012 |
| EP | 2 492 203 | | 8/2012 |
| EP | 2 492 204 | | 8/2012 |
| EP | 2 716 438 | A1 | 4/2014 |
| EP | 2 748 078 | B1 | 10/2016 |
| EP | 2 505 347 | B1 | 12/2016 |
| FR | 1 048 714 | A | 12/1953 |
| FR | 2 516 481 | | 5/1983 |
| FR | 2 665 882 | | 2/1992 |
| FR | 2 687 384 | | 8/1993 |
| GB | 632554 | | 11/1949 |
| GB | 833 296 | A | 4/1960 |
| GB | 2 293 569 | A | 4/1996 |
| GB | 2 351 035 | A | 12/2000 |
| GB | 2 365 000 | | 2/2002 |
| JP | S61-232175 | | 10/1986 |
| JP | 62-16319 | | 1/1987 |
| JP | S63-502418 | | 9/1988 |
| JP | 5-28626 | | 4/1993 |
| JP | 5-147664 | | 6/1993 |
| JP | 2004 224402 | | 8/2004 |
| JP | 2005-320022 | A | 11/2005 |
| JP | 2006-240671 | A | 9/2006 |
| JP | 2008-105707 | A | 5/2008 |
| JP | 2011-168330 | | 9/2011 |
| JP | 2011-168331 | | 9/2011 |
| JP | 2011-173640 | | 9/2011 |
| JP | 2011-189978 | A | 9/2011 |
| JP | 2010-222050 | | 10/2011 |
| JP | 2011-251774 | A | 12/2011 |
| JP | 2012-51579 | | 3/2012 |
| JP | 2012-152901 | | 8/2012 |
| JP | 2012-187899 | | 10/2012 |
| JP | 2012-533487 | | 12/2012 |
| JP | 2018-039167 | A | 3/2018 |
| NL | 87 840 | C | 11/1957 |
| WO | WO 87/03249 | | 6/1987 |
| WO | WO 2006/052326 | | 5/2006 |
| WO | WO 2007/067705 | | 6/2007 |
| WO | WO 2007/084525 | A2 | 7/2007 |
| WO | WO 2008/086277 | | 7/2008 |
| WO | WO 2009/023286 | | 2/2009 |
| WO | WO 2011/011283 | A2 | 1/2011 |
| WO | WO 2011/031545 | A2 | 3/2011 |
| WO | WO 2011/040994 | A1 | 4/2011 |
| WO | WO 2013/003149 | A1 | 1/2013 |
| WO | WO 2013/117983 | A2 | 8/2013 |
| WO | WO 2014/070232 | A1 | 5/2014 |

(56) References Cited

FOREIGN PATENT DOCUMENTS

| | | | |
|---|---|---|---|
| WO | WO 2015/028825 | A1 | 3/2015 |
| WO | WO 2015/036674 | A1 | 3/2015 |
| WO | WO 2016/176540 | A1 | 11/2016 |

OTHER PUBLICATIONS

Notice of Reasons for Refusal for Japanese Application No. 2018-501343 dated Jul. 6, 2020, with English translation.
International Search Report and Written Opinion for PCT/US2019/040772 dated Oct. 24, 2019.
Supplementary European Search Report for EP 19 83 3654 dated Jul. 4, 2022.
Supplementary Partial European Search Report for EP 19 83 3654 dated Mar. 10, 2022.

* cited by examiner

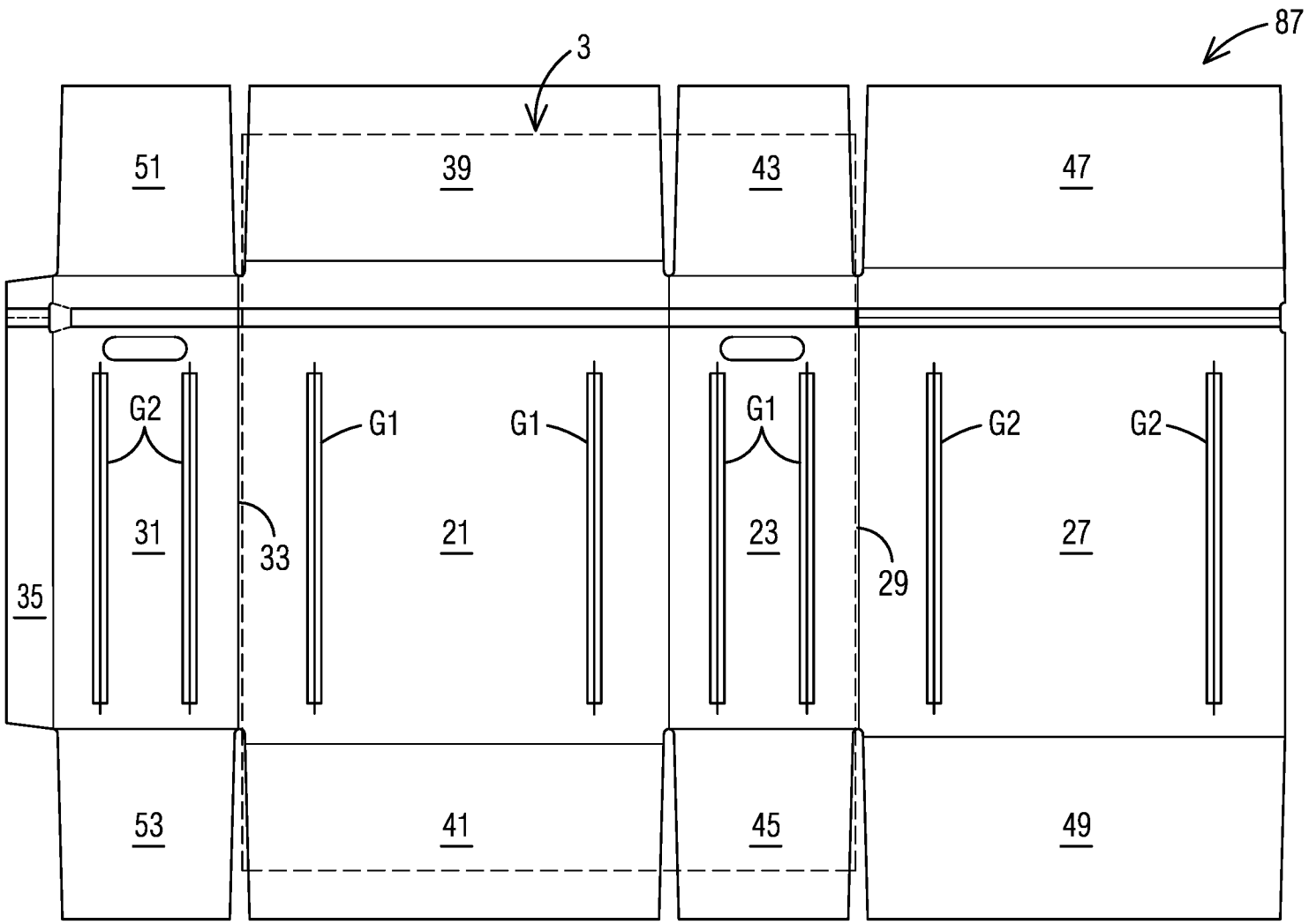
FIG. 3
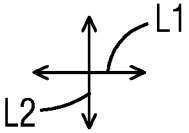

METHOD AND SYSTEM FOR FORMING PACKAGES

CROSS-REFERENCE TO RELATED APPLICATIONS

This application claims the benefit of U.S. Provisional Patent Application No. 62/695,375, filed on Jul. 9, 2018.

INCORPORATION BY REFERENCE

The disclosures of U.S. Provisional Patent Application No. 62/695,375, which was filed on Jul. 9, 2018, U.S. Provisional Patent Application No. 62/179,172, which was filed on Apr. 29, 2015, U.S. patent application Ser. No. 15/142,103, which was filed on Apr. 29, 2016, U.S. Provisional Patent Application No. 62/231,723, which was filed Jul. 14, 2015, U.S. patent application Ser. No. 15/209,013, which was filed Jul. 13, 2016, and U.S. Provisional Patent Application No. 62/542,863, which was filed on Aug. 9, 2017, are hereby incorporated by reference for all purposes as if presented herein in their entirety.

BACKGROUND OF THE DISCLOSURE

The present disclosure generally relates to reinforced packages for holding products and to methods of forming the packages. More specifically, the present disclosure is directed to methods and systems for forming the packages including a carton in combination with an interior bag or tubular liner.

SUMMARY OF THE DISCLOSURE

In general, one aspect of the disclosure is directed to a method of forming attached blanks. The method can comprise moving a blank in a machine direction on a blank conveyor, and forming a tubular web while moving a first web of material and a second web of material in the machine direction. The forming the tubular web can comprise at least partially sealing at least a portion of the first web and the second web together to form a sealed margin of the tubular web. The method further can comprise forming a liner by cutting the tubular web, forming an attached blank by attaching the liner to the blank, and moving the attached blank in the machine direction on the blank conveyor.

In another aspect, the disclosure is generally directed to a system for forming attached blanks. The system can comprise a blank conveyor moving a blank in a machine direction to an attachment station and a liner-forming assembly moving a first web and a second web in the machine direction. The liner-forming assembly can comprise a sealing station forming the first web and the second web into a tubular web. The sealing station can comprise a sealer that at least partially engages the first web and the second web to at least partially seal at least a portion of the first web and the second web together to form a sealed margin of the tubular web. The liner-forming assembly further can comprise a cutting station that receives the tubular web and comprises cutting features cutting the tubular web to form a liner. The system also can comprise an attachment station receiving the liner and the blank and attaching the liner to the blank to form an attached blank. The blank conveyor can move the attached blank in the machine direction.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

FIG. 3 is a plan view of an attached blank formed from the blank of FIG. 1 and the liner of FIG. 2 according to the system and method of forming attached blanks configured for the first exemplary embodiment of the disclosure.

Corresponding parts are designated by corresponding reference numbers throughout the drawings.

DETAILED DESCRIPTION OF THE EXEMPLARY EMBODIMENTS

The present disclosure generally relates to a system and method of forming reinforced packages for holding products such as food products or other articles. Packages according to the present disclosure can accommodate articles of any shape. The packages can comprise a bag or liner comprising a relatively flexible material attached to a reinforcing construct comprising a relatively rigid material (e.g., paperboard). The liners generally can be made from a paper, plastic, laminate, or other stock material and can be attached to an interior of the reinforcing construct. In one embodiment, the liners comprise polyethylene material or any other suitable heat-sealable material (e.g., the polyethylene can be an interior coating of the liner). The reinforcing construct can be a carton that can enclose the liner in an interior of the carton, and will provide support for the liner upon loading with a product or article or series of articles therein.

Figure 1:
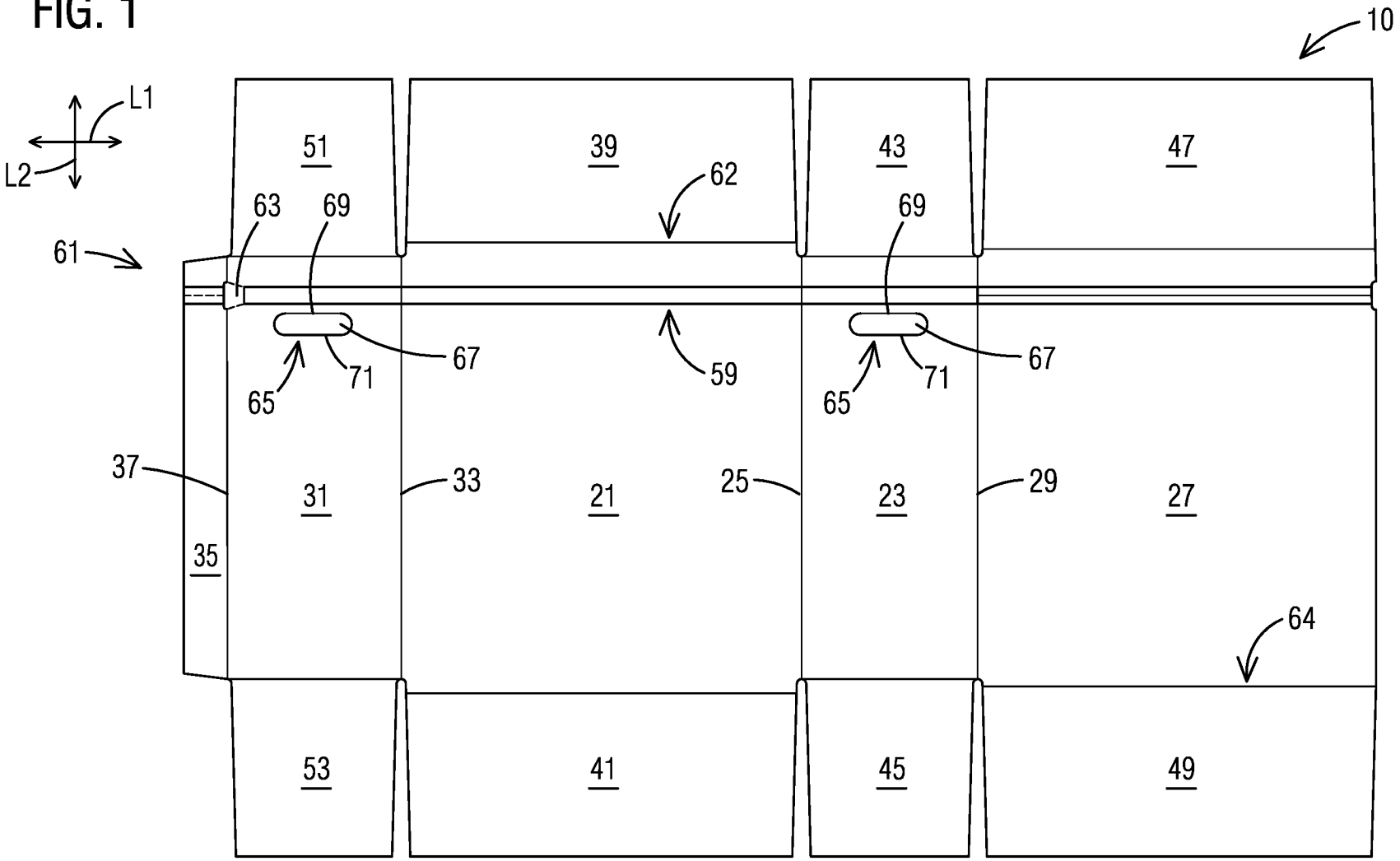
FIG. 1 is an interior plan view of a carton blank used to form an attached blank and a carton in accordance with a first exemplary embodiment of the disclosure.
Figure 6:
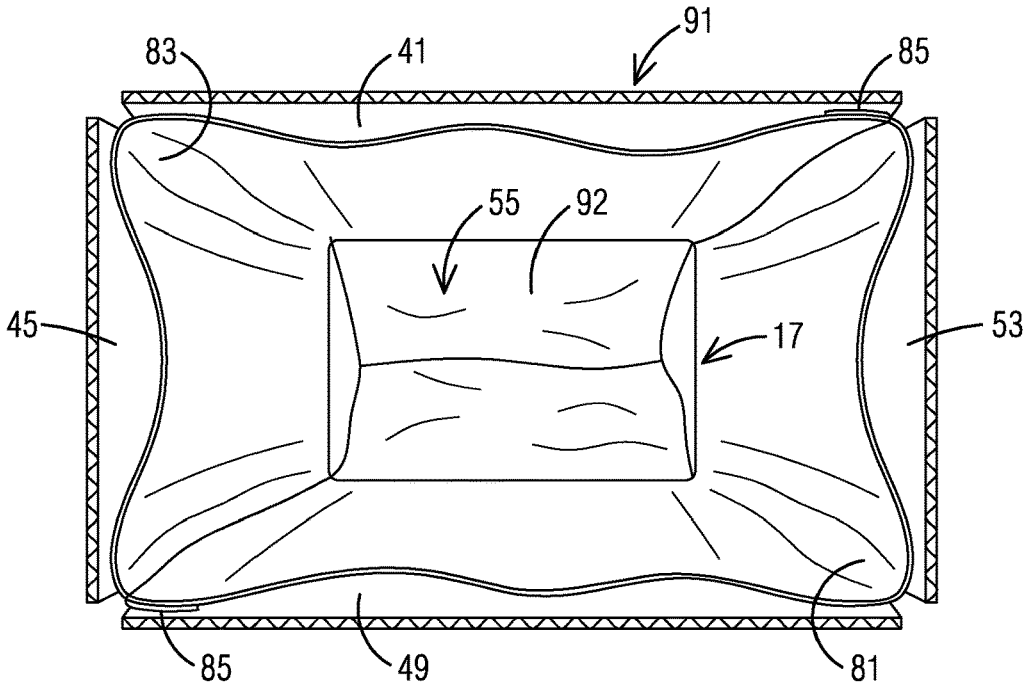
Figure 7:
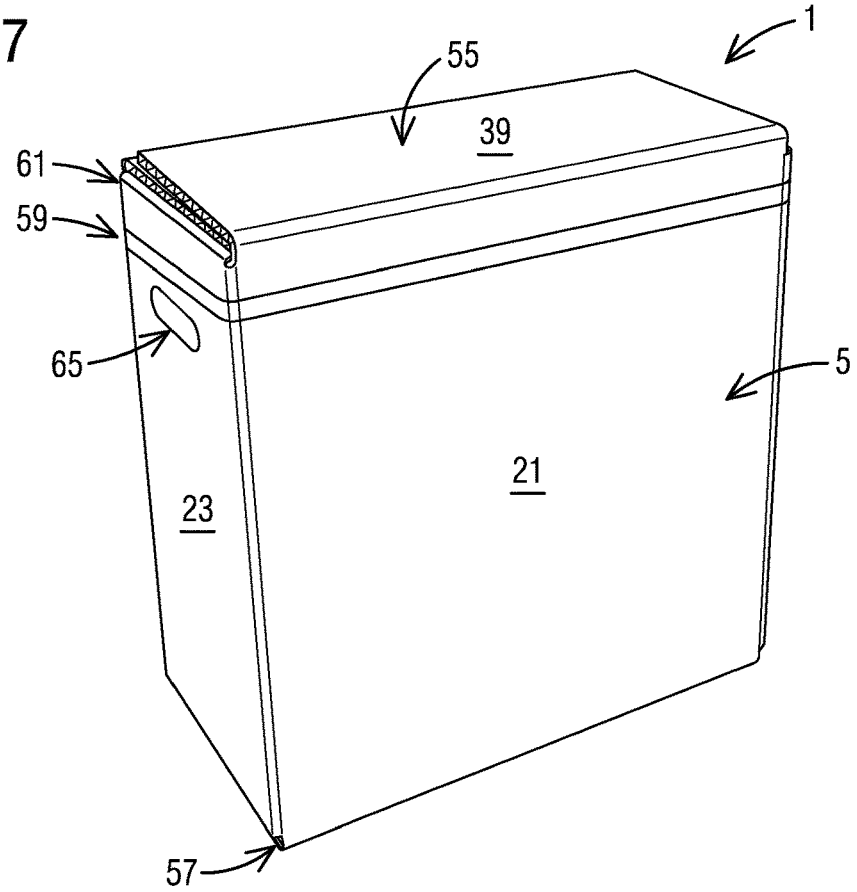
FIG. 7 is a perspective view showing the assembled carton in accordance with the first exemplary embodiment of the disclosure.

FIG. 1 illustrates a blank 10 for forming a carton 5 (FIG. 7) that is attached to a bag or liner 3 (FIGS. 2-6) to form a reinforced package, generally indicated at 1 (FIG. 7). The package 1 can be at least partially formed by one embodiment of the system and method of the present disclosure. The liner 3 has an interior space 17 (FIGS. 5 and 6) for holding a product (not shown). In one embodiment, the liner 3 has sealed and hemmed edges or sides 85 (FIG. 2) and extends in an interior of the carton 5 (FIG. 6) (e.g., on an interior surface of the carton 5). Alternatively, the liner 3 could be partially contained in the carton 5 without departing from the disclosure. In the illustrated embodiment, the package 1 can be used to house articles such as dry bulk materials or flowable materials (e.g., granular and/or particulate materials) and/or liquids or other materials or articles. In exemplary embodiments, the blank 10 can comprise a heavyweight and/or thick paperboard, multi-ply paperboard (e.g., Z-flute material available from Graphic Packaging International, LLC, of Atlanta, Ga.), and/or micro-flute or corrugated material. Further, the liner 3 can comprise paper, polymer, laminates, and/or other materials that are flexible and/or heat-sealable. In one embodiment, the liner 3 can comprise a laminate with a heat-sealable polyethylene interior surface. The blank 10 and/or the liner 3 could include other materials without departing from the disclosure.

As shown in FIG. 1, the carton blank 10 has a longitudinal axis L1 and a lateral axis L2. In the illustrated embodiment, the blank 10 comprises a front panel 21 foldably connected to a first side panel 23 at a first lateral fold line 25. A back panel 27 is foldably connected to the first side panel 23 at a second lateral fold line 29. A second side panel 31 is foldably connected to the front panel 21 at a third lateral fold line 33. In the illustrated embodiment, the blank 10 includes an attachment flap 35 foldably connected to the second side panel 31 at a fourth lateral fold line 37. Alternatively, the attachment flap 35 could be foldably connected to the back panel 27 or could be omitted without departing from the disclosure.

The front panel 21 is foldably connected to a front top flap 39 and a front bottom flap 41. The first side panel 23 is foldably connected to a first side top flap 43 and a first side bottom flap 45. The back panel 27 is foldably connected to a back top flap 47 and a back bottom flap 49. The second side panel 31 is foldably connected to a second side top flap 51 and a second side bottom flap 53. When the carton 5 is erected, the front and back top flaps 39, 47 and side top flaps 43, 51 close a first (e.g., top) end 55 of the carton (FIGS. 6 and 7), and the front and back bottom flaps 41, 49 and side bottom flaps 45, 53 close a second (e.g., bottom) end 57 of the carton (FIG. 7). In accordance with an alternative embodiment of the present disclosure, different flap arrangements can be used for at least partially closing the top and bottom ends 55, 57 of the carton 5.

The front and back top flaps 39, 47 and side top flaps 43, 51 extend along a first marginal area of the blank 10 and are foldably connected at a first longitudinal fold line 62 that extends along the length of the blank. The front and back bottom flaps 41, 49 and side bottom flaps 45, 53 extend along a second marginal area of the blank 10 and are foldably connected at a second longitudinal fold line 64 that also extends along the length of the blank. The longitudinal fold lines 62, 64 may be, for example, substantially straight, or offset at one or more locations to account for blank thickness or for other factors.

As shown in FIG. 1, the blank 10 can include a tear strip 59 or another opening feature for at least partially forming a dispenser opening (not shown) in the carton 5. In one embodiment, the tear strip 59 at least partially forms a dispenser section 61 that includes the top portions of the front panel 21, the back panel 27, the side panels 23, 31, and the attachment flap 35 as well as the top end flaps 39, 43, 47, 51. Accordingly, the tear strip 59 can be activated to at least partially separate the dispenser section 61 from the remainder of the carton 5 to form the dispenser opening. The tear strip 59 can comprise two spaced apart tear lines or other forms of weakening and a finger panel 63. In one embodiment, a tear tape (not shown) can extend along the tear strip 59 (e.g., on an interior surface of the blank) for reinforcing the tear strip and helping to tear the carton 5 when actuating the tear strip. The tear strip 59 and the dispenser section 61 could be omitted or could be otherwise shaped, arranged, configured, and/or positioned without departing from the disclosure.

In the illustrated embodiment, the blank 10 includes a handle 65 in each of the side panels 23, 31 for grasping and carrying the carton. Each of the handles 65 can include a handle flap 67 foldably connected to the respective side panel 23, 31 along a respective longitudinal fold line 69 and can be separable from the respective side panel 23, 31 along a respective cut line 71. The handle flaps 67 can be folded inwardly in the carton 5 to form handle openings for grasping the carton at the handles. The handles 65 could be omitted or could be otherwise shaped, arranged, configured, and/or positioned without departing from the disclosure. For example, a handle could be included in the top end 55 and/or the one or both of the handles 65 could include handle openings (not shown) in addition to or instead of the handle flaps 67.

The blank 10 could be otherwise shaped, arranged, and/or configured without departing from the disclosure.

Figure 2:
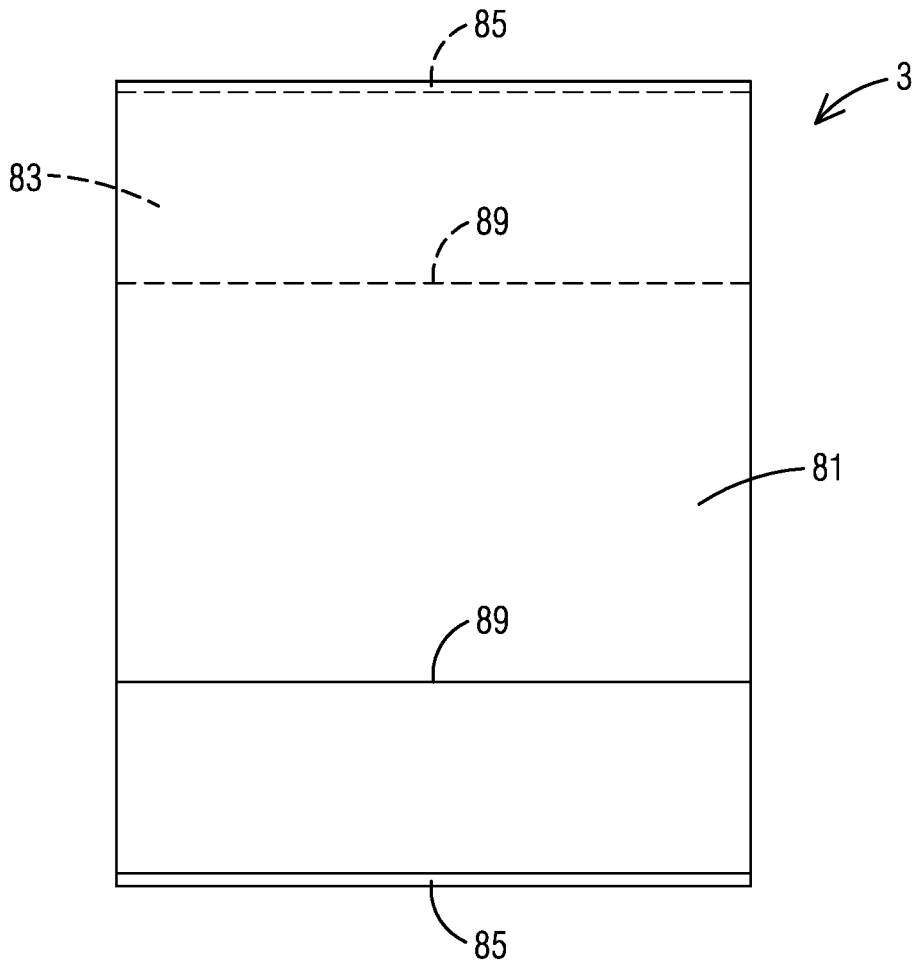
FIG. 2 is a plan view of a liner formed according to a system and method of forming attached blanks configured for the first exemplary embodiment of the disclosure.

As shown in FIG. 2, the liner 3 can include a first sheet 81 and a second sheet 83, wherein the first sheet 81 overlaps the second sheet 83 in FIG. 2. The first sheet 81 and the second sheet 83 can be secured together at the hemmed edges or hems 85 of the liner 3. In the illustrated embodiment, the hemmed edges 85 can be formed by heat sealing or otherwise securing the marginal portions of the sheets 81, 83 together to form sealed margins 84 (FIG. 9), folding the sealed margins 84 over and against the sheets 81, 83, and adhering the sealed margins 84 to the sheets 81, 83. In one embodiment, sealed margins 84 are folded in opposite directions so that one of the hemmed edges 85 is secured to the first sheet 81 and the other is secured to the second sheet 83 (shown in phantom in FIG. 2) to help avoid stretching and/or bunching of material that could occur if the sealed margins 84 were folded in the same direction and the hemmed edges 85 were secured to the same sheet. In one embodiment, the liner 3 can fold along the hemmed edges 85 and along lines 89 in the sheets 81, 83 to form the interior space 17 of the liner 3 when the package 1 is fully erected. The lines 89 are shown schematically in FIG. 2. The liner can be formed by a system as described in more detail below. The liner 3 could be otherwise shaped, arranged, and/or configured without departing from the disclosure.

As shown in FIG. 3, the liner 3 can be attached to the blank 10 (e.g., as described in more detail in relation to the system below). In one embodiment, the combination of the blank 10 and the liner 3 as shown in FIG. 3 can be considered an attached blank 87. Generally, the second sheet 83 of the liner 3 can be secured to the front panel 21 and the first side panel 23 (such as by glue strips G1) to form the attached blank 87 in an exemplary embodiment. In the illustrated embodiment, the hemmed edges 85 can be disposed adjacent to the fold lines 29, 33.

Figure 4:
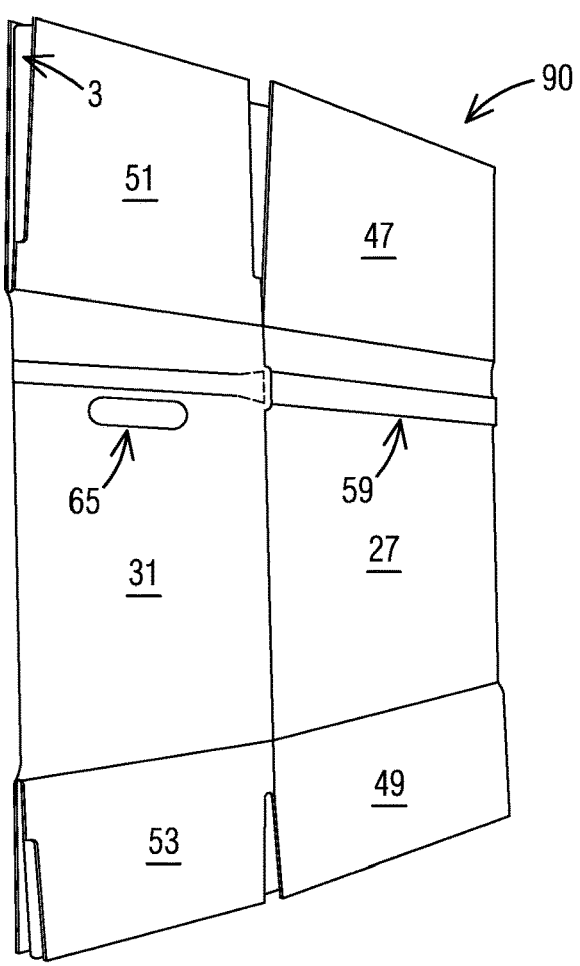
FIGS. 4-6 are perspective views showing the formation of the carton from the attached blank of FIG. 3 according to the first exemplary embodiment of the disclosure.

As shown in FIG. 3, glue strips G2 can be applied to the back panel 27 and the second side panel 31. Subsequently, as shown in FIG. 4 the blank 10 can be formed into an open-ended sleeve 90 by folding the back panel 27 and the second side panel 31 along the respective fold lines 29, 33 to adhere the back panel 27 and the second side panel 31 to the first sheet 81 with the glue strips G2. The attachment flap 35 can be secured (e.g., glued) to the back panel 27. The open-ended sleeve 90 is shown in FIG. 4 in a collapsed state with the liner 3 attached to the interior of the open-ended sleeve 90.

Figure 5:
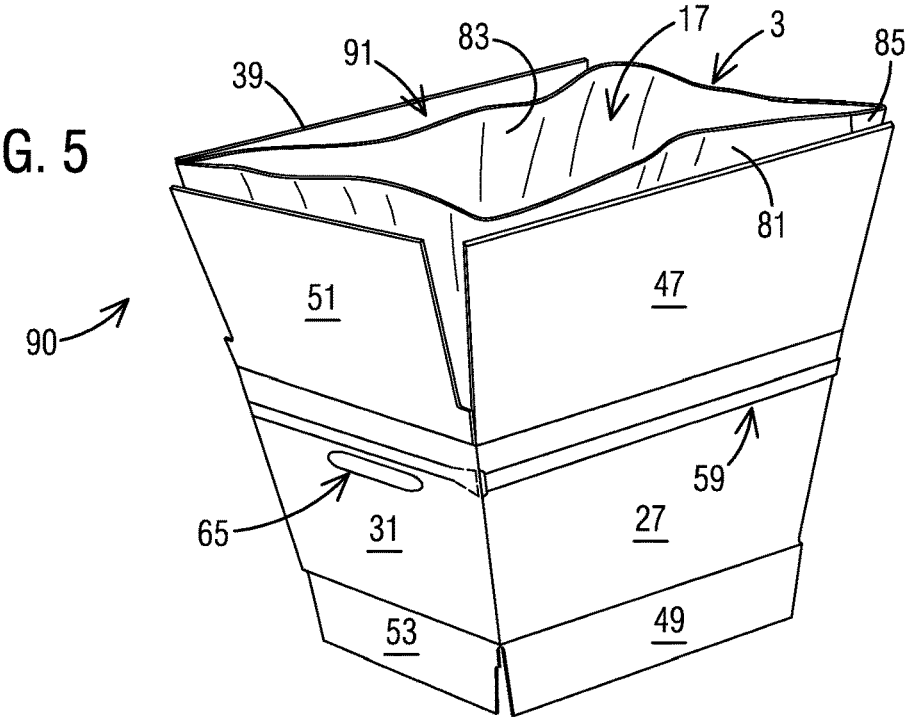

In one embodiment, the open-ended sleeve can be folded along the fold lines 25, 29, 33, 37 to position the front panel 21 opposite to the back panel 27 and the side panels 23, 31 opposite one another so that the front panel 21, the back panel 27, and the side panels 23, 31 extend around an interior 91 of the open-ended sleeve 90 (FIG. 5). Since the liner 3 is attached to the panels 21, 23, 27, 31, the liner will open with the open-ended sleeve to extend around the interior 91. In this configuration, the liner 3 folds where each of the fold lines 25, 29, 33, 35 overlap the liner 3. For example, the liner can fold where the marginal portions of the sheets 81, 83 were folded to form the hemmed edges 85, which can generally line up with the fold lines 29, 33, and along folds 89 (shown schematically in FIG. 2), which can be generally aligned with the fold lines 25, 37 in one embodiment.

In the illustrated embodiment, the package 1 (FIG. 7) can be formed by closing the ends of the liner 3 and the carton 5. As shown in FIGS. 3-6, the liner 3 can extend farther in the lateral direction L2 than the panels 21, 23, 27, 31 so that the liner 3 partially overlaps the end flaps 39, 43, 41, 45 of the blank 10 and the end flaps 39, 43, 47, 51, 41, 45, 49, 53 in the open-ended sleeve 90. In the illustrated embodiment, the liner 3 is not adhered to the end flaps. The ends of the liner 3 extend above and below the panels 21, 23, 27, 31 of the blank 10 and the open-ended sleeve 90 so that one or both of the ends of the liner 3 can be folded and/or sealed for holding a product in the interior of the liner 3. As shown in FIG. 6, the liner 3 at the top end of the open-ended sleeve 90 (e.g., the end that forms the closed top end 55 in the package 1) can be sealed closed to form a sealed top 92 of the liner 3 and folded over the end of the open-ended sleeve 90. In one embodiment, one or both of the ends of the liner 3 can be sealed by welding, heat sealing, gluing, or any other suitable sealing or closing method. In the illustrated embodiment, the side top flaps 43, 51 can be folded over the end of the open-ended sleeve 90 so that portions of the sealed end 92 of the liner 3 that overlap the side top flaps 43, 51 are also folded over the end. The front and back top flaps 39, 47 can be folded over the side top flaps 43, 51 to form the closed top end 55. In one embodiment, the overlapped top flaps 39, 43, 47, 51 can be glued in the closed top end 55. The closed top end 55 with the sealed end 92 of the liner 3 is shown in FIG. 6 from the interior 91.

In the illustrated embodiment, the bottom end 57 can be closed similarly or identically to the top end 55. For example, the bottom end of the liner 3 can be folded and/or sealed closed and the bottom flaps 41, 49, 45, 53 can be folded to be at least partially overlapped with one another to form the closed bottom end 57. In one embodiment, the overlapped bottom flaps can be glued at the closed bottom end 57. In the illustrated embodiment, the ends 55, 57 of the carton 5 can be closed in either order and a product (not shown) can be loaded into the interior 17 of the liner 3, which is in the interior 91 of the carton 5, prior to closing one of the ends. The package 1 could be otherwise formed without departing from the disclosure.

Figure 8:
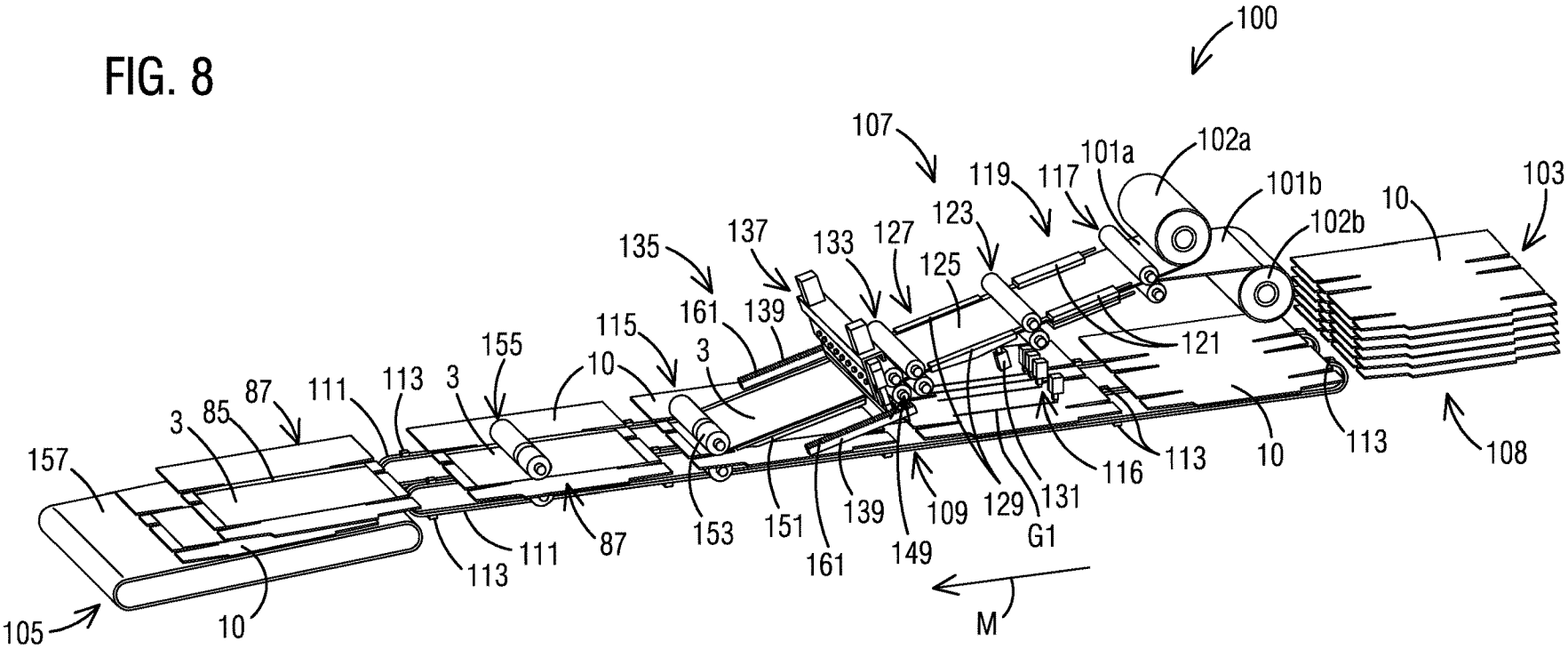
FIG. 8 is a perspective view of the system for forming attached blanks configured for the first exemplary embodiment of the disclosure.
Figure 9:
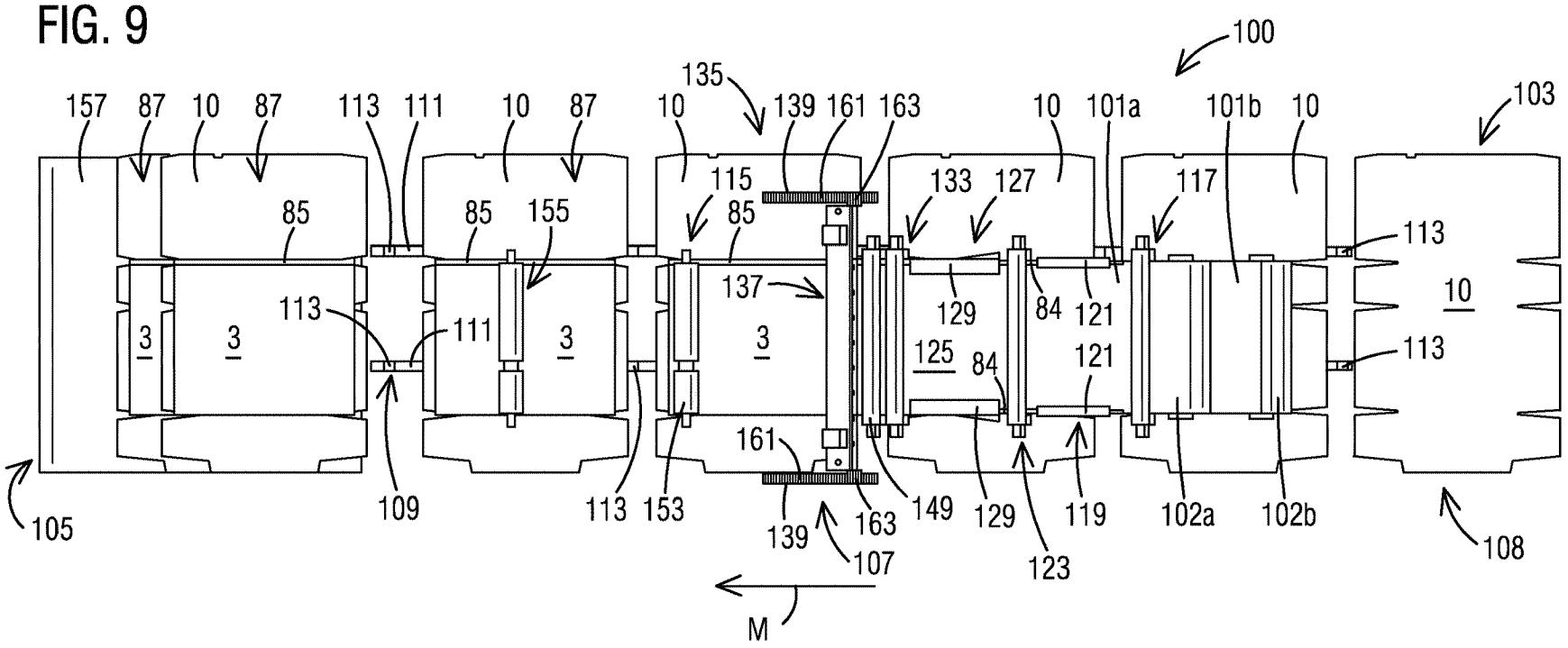
FIG. 9 is a plan view of the system of FIG. 8.
Figure 10:
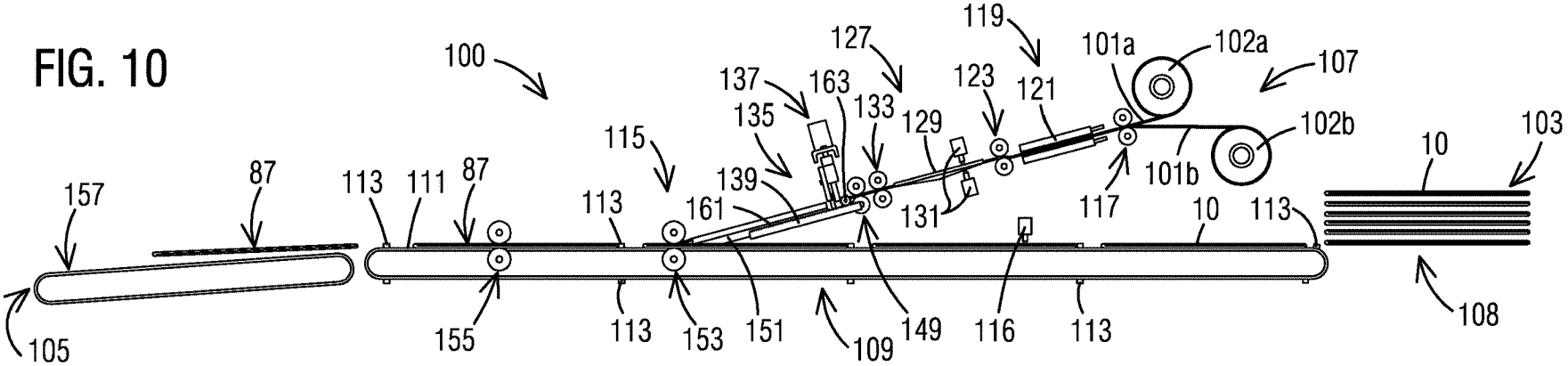
FIG. 10 is an elevation view of the system of FIGS. 8 and 9.

FIGS. 8-10 generally illustrate an example embodiment of a system and method 100 for forming the attached blanks 87 (e.g., for forming the reinforced packages 1) in accordance with the disclosure. In the illustrated embodiment, the packaging system 100 moves the blanks 10 and two webs of material 101*a*, 101*b* from an upstream end 103 to a downstream end 105 generally in a machine direction M (e.g., the downstream direction) to form the tubular liners 3 and to attach the liners 3 to the respective blanks 10 to form the attached blanks 87 by various portions and components of the system as discussed further below. Subsequently, the attached blanks 87 can be formed into the packages 1.

As illustrated in FIGS. 8-10, in the system and method 100 for manufacturing reinforced packages 1, the webs of liner material 101*a*, 101*b* are fed from a respective roll or supply 102*a*, 102*b* through a liner-forming assembly 107. In an exemplary embodiment, one or both of the webs of liner material 101*a*, 101*b* can include preprinted or unprinted paper, polyethylene, laminates, or other material including flexible and heat-sealable materials. In the illustrated embodiment, the liner material 101*a*, 101*b* can be preprinted with various designs, lettering, labels and/or other graphics and can have a heat-sealable coating on the interior surfaces (e.g., the surfaces of the webs that face one another). In an alternative embodiment, one or both of the webs 101*a*, 101*b* could be perforated, printed roll stock that can include patterned adhesive and/or heat-sealable material that is positioned to facilitate forming the liners 3 in the formed packages 1.

In one embodiment, a blank feeder (not shown) is positioned at the upstream end 103 of the system 100 and includes a stack 108 of carton blanks 10 that are fed to a blank conveyor 109. In one embodiment, the blank feeder could be a pick and place type blank feeder, a belt feeder, or any other suitable feeder mechanism. In one embodiment, the blank feeder sequentially moves blanks 10 from the stack 108 to the blank conveyor 109, which can move the blanks 10 in the machine direction M towards the downstream end 105. Alternatively, the blank feeder could comprise other types of feeders such as mechanisms that convey blanks 10 directed from a blank forming station, or any other suitable types of feeders or other mechanisms without departing from the disclosure.

In the illustrated embodiment, the blank conveyor 109 includes two spaced apart lug belts or tracks 111 with lugs 113 that engage the blanks 10 and convey the blanks in the machine direction M. In the illustrated embodiment, the lug belts 111 can be endless belts, each with a plurality of the lugs 113 spaced along the respective belt. In one embodiment, the lugs 113 can be spaced on the lug belts 111 by at least the height of the liners 3 and the blanks 10 in the attached blanks 87 (e.g., the height of the liners 3 and blanks 10 can be measured in the L2 direction in FIG. 3 in one embodiment). The blank conveyor 109 receives the blanks 10 and moves the series of blanks 10 to an attachment station 115 of the packaging system 100 wherein the liners 3 are attached to the blanks 10 by adhesive. The blank conveyor 109 can include one or more brushes (not shown) or other suitable retaining and/or restraining features that can engage the blanks 10 as the lug belts 111 move the blanks 10 past the brushes. Accordingly, as the lug belts 111 move the blanks 10 downstream, the brushes can drag against the blanks 10 and push the blanks against the respectively adjacent lugs 113 so that, for example, the blanks 10 can be properly positioned for attachment to the respective liners 3 in the attachment station 115. Subsequently, the lugs 113 can push the respective blanks 10 toward the attachment station 115 overcoming the resistance of the brushes. In the illustrated embodiment, adhesive applicators 116 can apply adhesive (e.g., glue strips G1) to the blanks 10 (e.g., on at least panels 21, 23) as the blank conveyor 109 moves the blanks 10 toward the attachment station 115.

As shown in FIGS. 8-10, the liner-forming assembly 107 can include at least the rolls 102*a*, 102*b*, a sealing station 119, a folding station 127, and a cutting station 135. In one embodiment, the webs of material 101*a*, 101*b* can be unrolled from the respective rolls 102*a*, 102*b* and brought into face-to-face contact with one another (e.g., so that the inner surface of the web 101*a* is in face-to-face contact with the inner surface of the web 101*b*, wherein the inner surfaces of the webs 101*a*, 101*b* become the inner surface of the liner 3) between two rollers 117. In the illustrated embodiment, the rollers 117 can guide and/or drive the face-contacting webs 101*a*, 101*b* in the machine direction M toward the sealing station 119 (e.g., a tube-forming station). In one embodiment, the sealing station 119 can include two sealers 121 (e.g., linear sealers), each aligned with a respective marginal portion of the face-contacting webs 101*a*, 101*b*. Accordingly, the sealers 121 can apply heat and/or pressure to the marginal portions of the webs 101*a*, 101*b* to help fuse the inner surfaces of the marginal portions of the webs 101*a*, 101*b* together (e.g., at a heat-sealable inner coating). A pair of nip rollers 123 can further press the webs 101*a*, 101*b* together to form the sealed margins 84 of the webs after the webs exit the sealers 121. In one embodiment, the sealed webs 101*a*, 101*b* generally can be a tubular web 125, which can be further driven in the machine direction M by the nip rollers 123.

In the illustrated embodiment, the tubular web 125 can move in the machine direction M from the sealing station 119 to the folding station 127, which can include two folders 129 and two glue applicators 131, each aligned with respective sealed marginal portions of the tubular web 125. As shown in FIGS. 8-10, the bottom side folder 129 can engage one of the sealed marginal portions of the tubular web 125 and the glue applicator 131 can apply glue (not shown) to the tubular web 125 adjacent the sealed margin 84 and/or on the sealed margin 84. The folder 129 can gradually fold the sealed margin 84 under the remainder of the tubular web 125 and against the downward face of the bottom web 101*b* (which will become the second sheet 83 of the liner 3). The glue applied by the glue applicator 131 can adhere the sealed marginal portion to the face of the web 101*b* to form the hemmed edge 85 of the liner 3. The opposing folder 129 at the opposite edge of the tubular web 125 can similarly fold the opposing sealed margin 84 upwardly, over the remainder of the tubular web 125 and against the upward face of the top web 101*a* (which will become the first sheet 81 of the liner 3). Glue applied by an opposing glue applicator 131 (FIG. 10) can adhere the sealed marginal portion to the upper face of the top web 101*a* to form the other hemmed edge 85 of the tubular web 125. A pair of nip rollers 133 can press the sealed marginal portions against the faces of the webs 101*a*, 101*b* to further form the hemmed edges 85 after the webs exit the folders 129. The tubular web 125 can be further driven in the machine direction M by the nip rollers 133.

Figure 11:
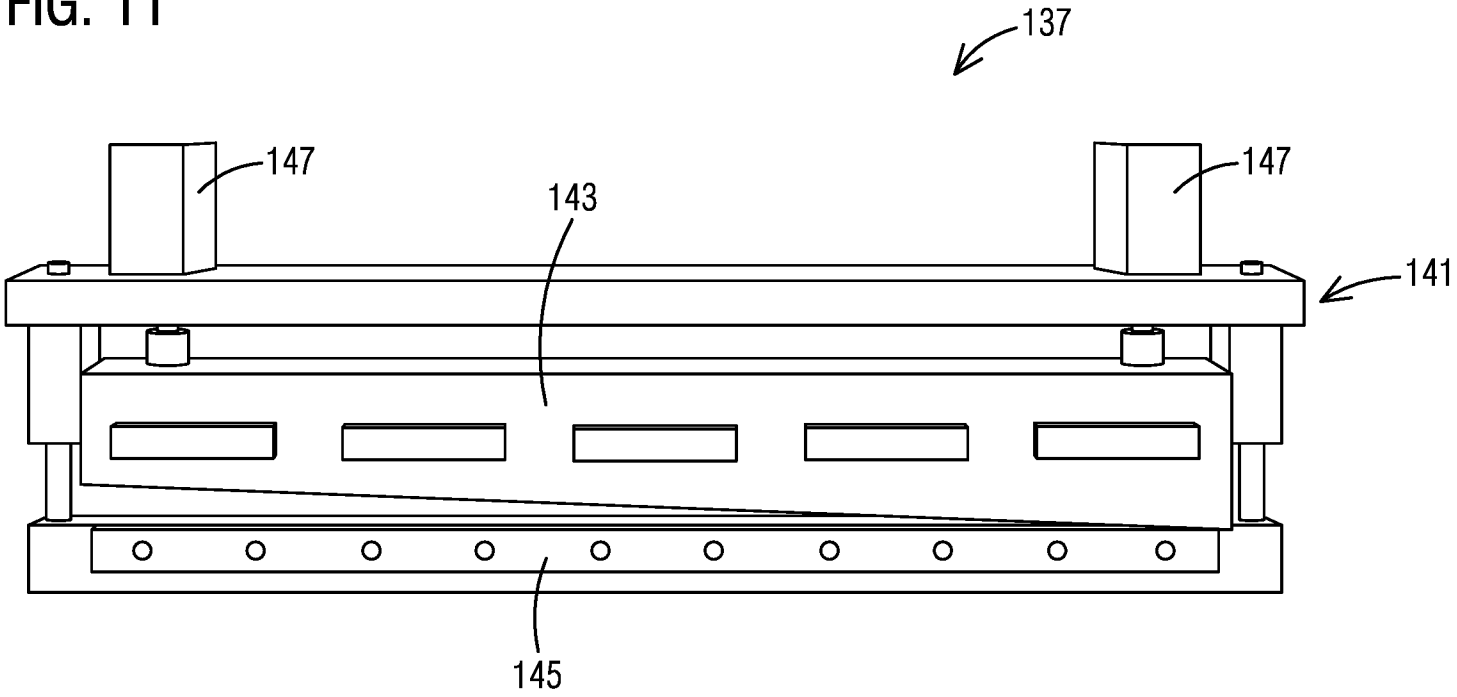
FIG. 11 is an elevation view of a knife assembly of the system of FIGS. 9-11.

As shown in FIGS. 8-10, the tubular web 125 can move from the nip rollers 133 to the cutting station 135, which can include a knife assembly 137 mounted on an adjustable rack 139. In the illustrated embodiment, the knife assembly 137 can be a guillotine-style sheeter, such as the SUR-CUT™ Guillotine Knife Assembly available from Azco Corp. of Fairfield, N.J. As shown in FIG. 11, the knife assembly 137 can include a frame 141, which is mounted to the adjustable rack 139, an upper knife blade 143 mounted to an upper crossbar of the frame 141, a base knife blade 145 mounted to a lower crossbar of the frame 141, and two knife actuators 147 mounted to the upper crossbar of the frame 141. The knife actuators 147 can be pneumatic actuators or any other suitable actuators. In the illustrated embodiment, the knife actuators 147 are operable to move the upper knife blade 143 downwardly to cut the tubular web 125 between the upper knife blade 143 and the base knife blade 145 and to return the upper knife blade 143 to its starting position (e.g., the uppermost position). As shown in FIGS. 8-10, the cutting station 135 can include a pair of rollers 149, which can guide and/or drive the tubular web 125 through the knife assembly 137. In one embodiment, the rollers 149 can be nip rollers. In the illustrated embodiment, the rollers 149 can be mounted to the frame 141 and/or the adjustable rack 139. The cutting station 135 can include one or more liner guides 151, which can be positioned downstream from the knife assembly 137 to support a portion of the tubular web 125 that has passed through the knife assembly 137 and to support the liner 3 in the cutting assembly 135 after the liner 3 is cut from the tubular web 125. As shown in FIGS. 8-10, a pair of combining nip rollers 153 can be positioned on the blank conveyor 109 at the downstream end of the cutting station 135.

In the illustrated embodiment, the position of the knife assembly 137 and the pair of rollers 149 can be adjusted on the adjustable rack 139 so that the distance between the nip rollers 153 and the cutting location of the knife blades 143, 145 is less than or equal to the height of the liner 3. For example, in an embodiment with a smaller liner and/or blank, the knife assembly 137 can be moved toward the nip rollers 153 to accommodate the smaller liner (e.g., see FIGS. 15-17). Accordingly, the heights (e.g., the L2 dimension in FIG. 3) of the liners 3 can be set by adjusting the position of the knife assembly 137 on the adjustable rack 139. In one embodiment, the liner guides 151 can be replaced or adjusted to fit between the knife assembly 137 and the nip rollers 153. In the illustrated embodiment, the knife assembly 137 can be mounted to the adjustable rack 139 by a rack-and-pinion assembly that can include a grooved top 161 (e.g., the rack portion of the rack-and-pinion assembly) of the adjustable rack 139 and a pinion 163 extending from the frame 141 of the knife assembly 137. In one embodiment, the pinion 163 can intermesh with the grooved top 161 to facilitate adjustment of the position of the knife assembly 137 on the adjustable rack 139. Accordingly, the knife assembly 137 can be moved on the adjustable rack 139 in the machine direction M (e.g., toward and away from the combining nip rollers 153 of the attachment station 115) as the pinion 161 engages the grooved top 163. The cutting station 135 could be otherwise shaped, arranged, and/or configured without departing from the disclosure.

As the tubular web 125 moves in the machine direction M (e.g., driven by one or more of the pairs of rollers 117, 123, 133, 149, 153) from the folding station 127, the tubular web 125 moves between the rollers 133 and then between the rollers 149, which guide the tubular web 125 through the knife assembly 137, between the knife blades 143, 145. The tubular web 125 can slide along the liner guides 151 and then a downstream end of the tubular web 125 can engage a blank 10 moving on the blank conveyor 109. As the blank 10 and the downstream edge of the tubular web 125 move in the machine direction M, they can move between the nip rollers 153. Once a pre-determined amount of the tubular web 125 has passed through the knife assembly 137 (e.g., the distance between the downstream end of the tubular web 125 and the knife blades 143, 145 is the pre-determined height of the liner 3), the knife actuators 147 can be operated to move the upper knife blade 143 downwardly to cut the tubular web 125 between the upper knife blade 143 and the base knife blade 145. In one embodiment, the cut portion of the tubular web 125 downstream from the knife assembly 137 is the liner 3. As shown in FIGS. 8-10, as the blank 10 is moved in the machine direction M by the blank conveyor 109, and the blank 10 and the liner 3 are engaged by the nip rollers 153, the rolling of the nip rollers 153 can continue to move the liner 3 in the machine direction M along the liner guides 151 while pressing the liner 3 against the blank 10 (e.g., against the panels 21, 23). Accordingly, the combining pressure of the nip rollers 153 against the panels 21, 23 of the blank 10 and the liner 3 can help adhere the liner to the panels 21, 23 (e.g., by the glue strips G1 applied by the glue applicators 116).

In one embodiment, the tubular web 125 can be moved in the machine direction M at a constant or substantially constant rate, and the normal motion of the upper knife blade 143 can temporarily block the downstream motion of the tubular web 125 as the knife assembly 137 is actuated. Accordingly, the tubular web 125 can be temporarily blocked from moving through the knife assembly 137 from the rollers 149 while the knife assembly 137 is cutting the liner 3 from the tubular web 125. This can lead to some bunching of the tubular web while the upper knife blade 143 is reciprocated by the knife actuators 147. The knife actuators 147 can be configured to reciprocate the upper knife blade 143 quickly to minimize the bunching of the tubular web 125 and to allow the tubular web 125 to recover quickly and move through the knife assembly 137 after the cutting.

In an alternative embodiment, the frame 141 of the knife assembly 137 can be mounted to the adjustable rack 139 by linear actuators (not shown). The linear actuators can be configured to move the knife assembly 137 in the machine direction M at the same rate or at a similar rate as the tubular web 125 moves in the machine direction M while the knife actuators 147 reciprocate the upper knife blade 143 during the cutting of the liner 3 from the tubular web 125. As the upper knife blade 143 is returned to its uppermost position (e.g., the open position of the knife assembly 137), or after the knife blade 143 is returned to its uppermost position, the linear actuators can return the knife assembly 137 to its upstream position to prepare the knife assembly 137 for another cutting cycle. In another alternative embodiment, the knife assembly 137 could be replaced by a rotary cutter (e.g., which can be similar to the rotary cutter described and shown in the incorporated-by-reference U.S. patent application Ser. No. 15/142,103 or U.S. Provisional Patent Application No. 62/524,863).

In the illustrated embodiment, the combined blank 10 and liner 3 (e.g., the attached blank 87) can continue to move in the machine direction M on the blank conveyor 109 from the combining nip rollers 153 through a pair of compression nip rollers 155, which can further help adhere the liner 3 to the blank 10. In the illustrated embodiment, the combining nip rollers 153 and the compression nip rollers 155 each can have one or more gaps to accommodate the lug belts 111 (e.g., so that the lug belts 111 and the lugs 113 are not pressed between the combining nip rollers 153 and between the compression nip rollers 155). Subsequently, the attached blanks 87 can be moved to an output conveyor 157, which can stack the attached blanks 87 for storage and/or transport for further processing (e.g., further folding and gluing to form the packages 1). Alternatively, the system 100 can continuously pass the attached blanks 87 from its downstream end 105 to another system (e.g., a folder-gluer) for further processing the attached blanks 87.

Figure 12:
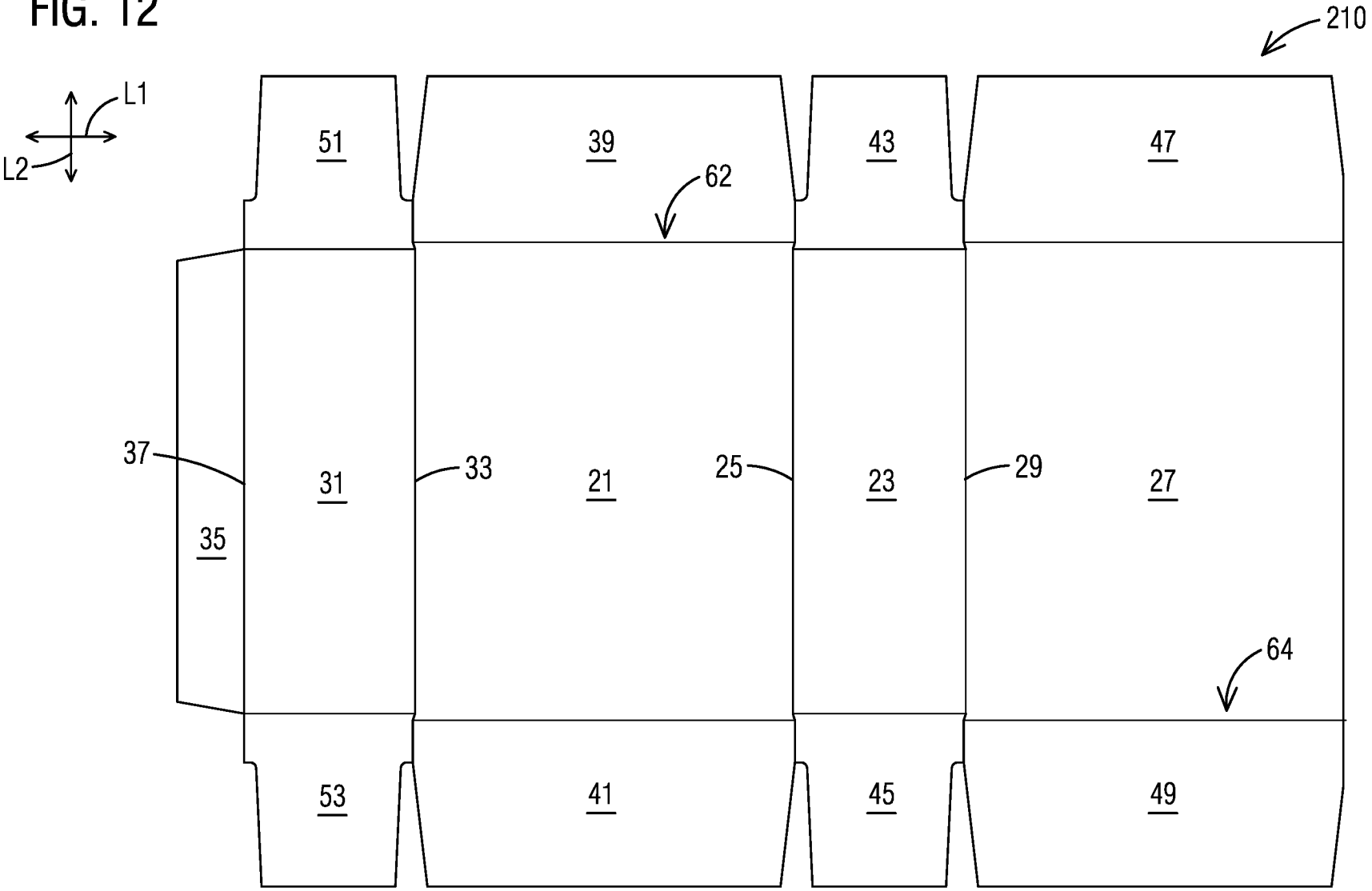
FIG. 12 is an interior plan view of a carton blank used to form an attached blank and a carton in accordance with a second exemplary embodiment of the disclosure.
Figure 13:
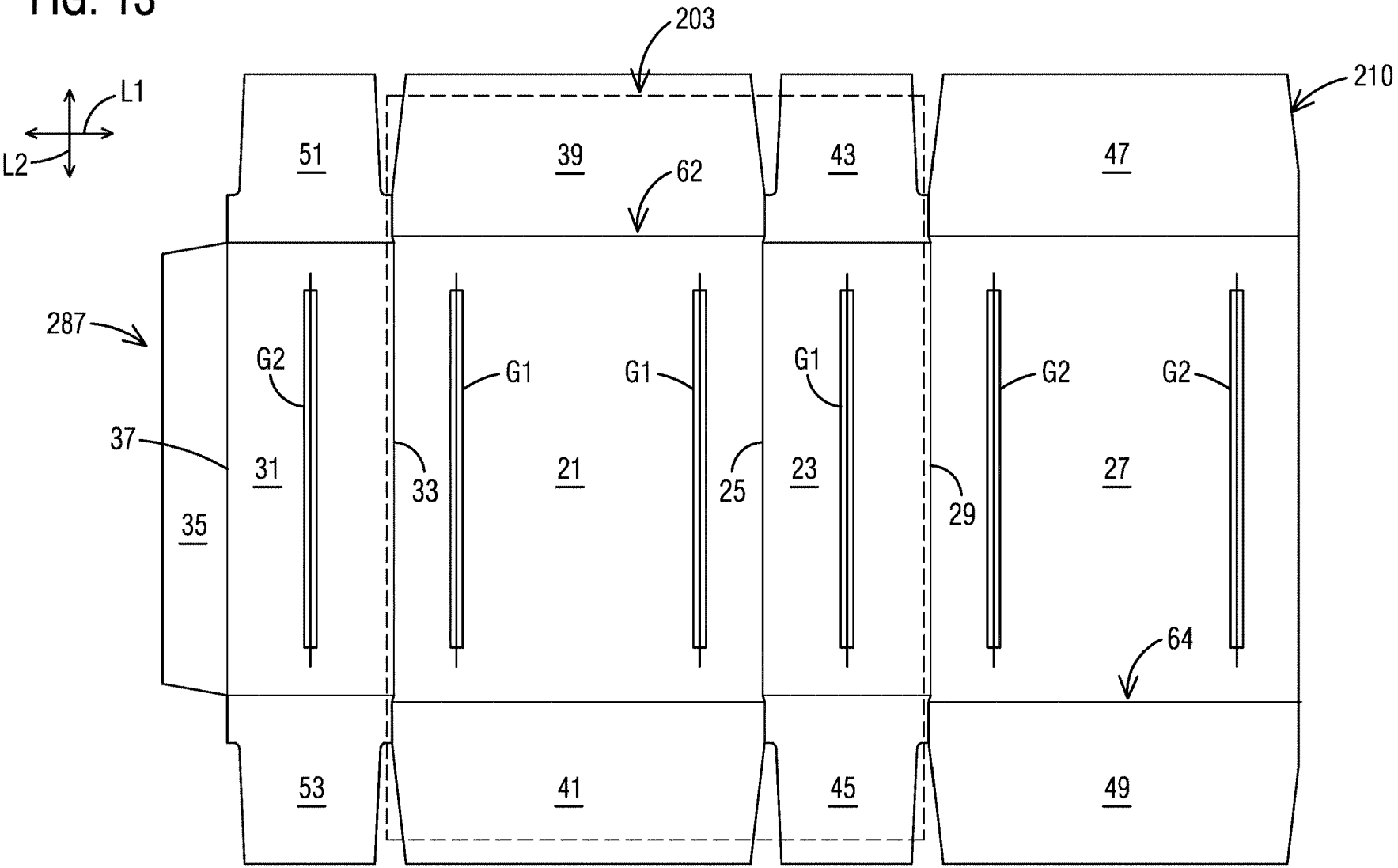
FIG. 13 is a plan view of an attached blank formed according to the system and method of forming attached blanks configured for the second exemplary embodiment of the disclosure.
Figure 14:
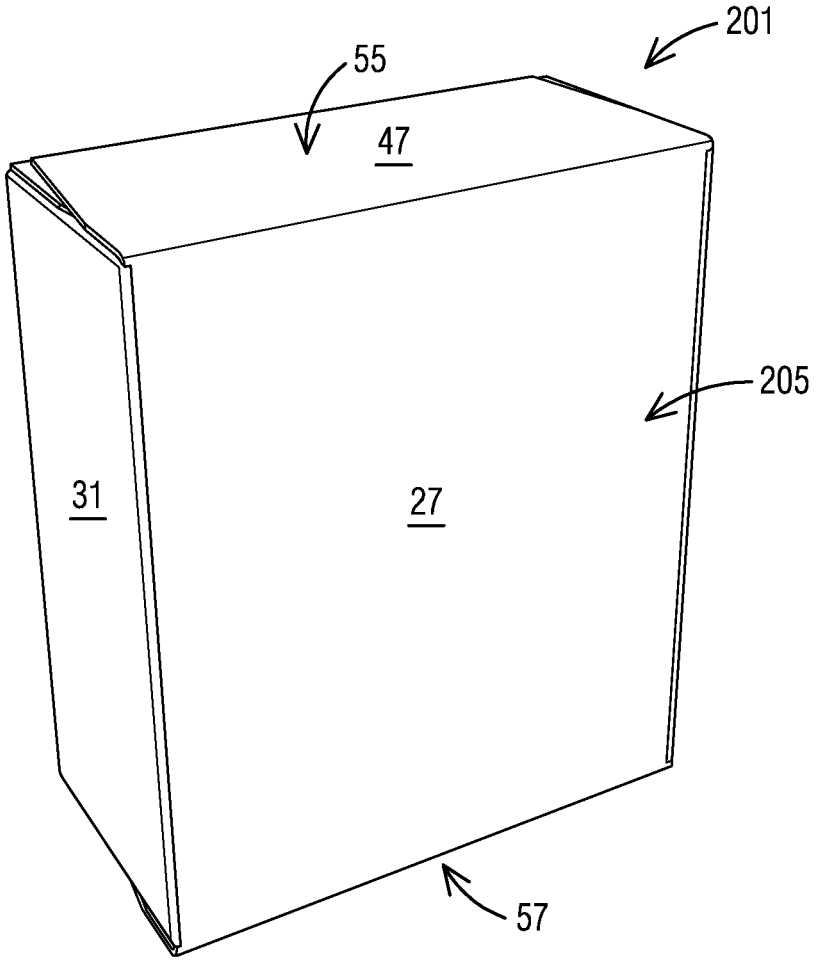
FIG. 14 is a perspective view showing the assembled carton in accordance with the second exemplary embodiment of the disclosure.
Figure 15:
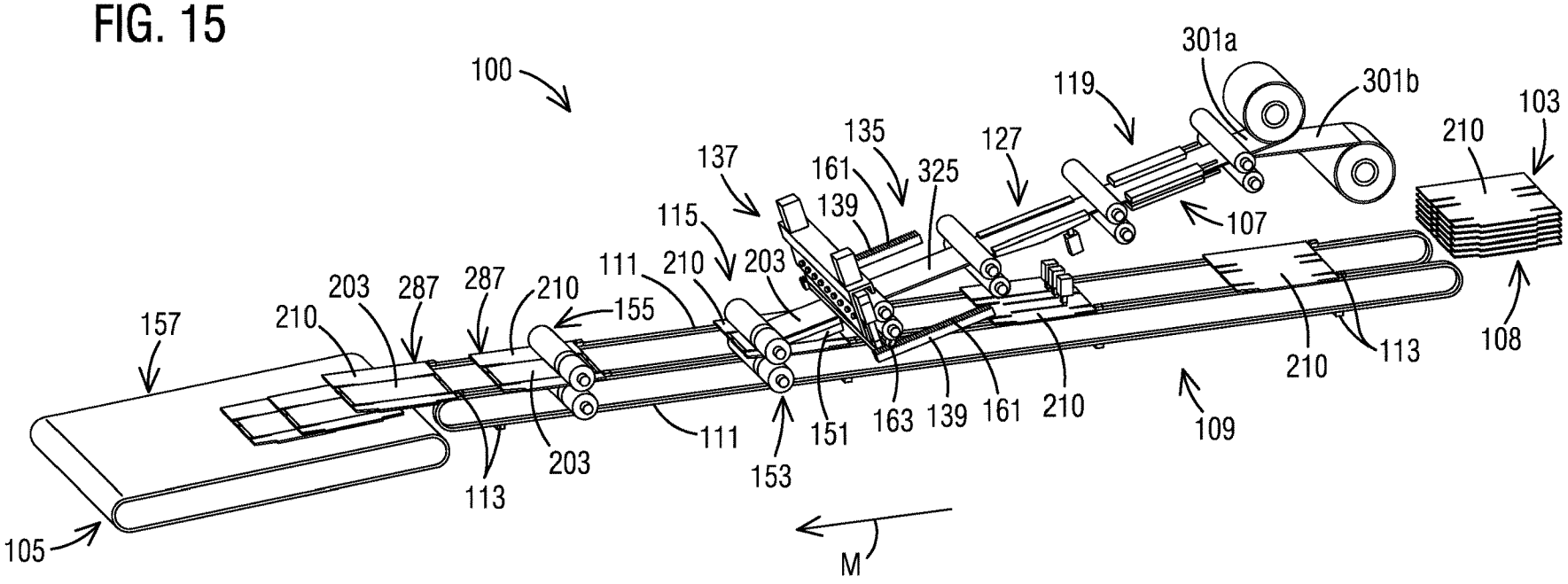
FIG. 15 is a perspective view of the system for forming attached blanks configured for the second exemplary embodiment of the disclosure.
Figure 16:
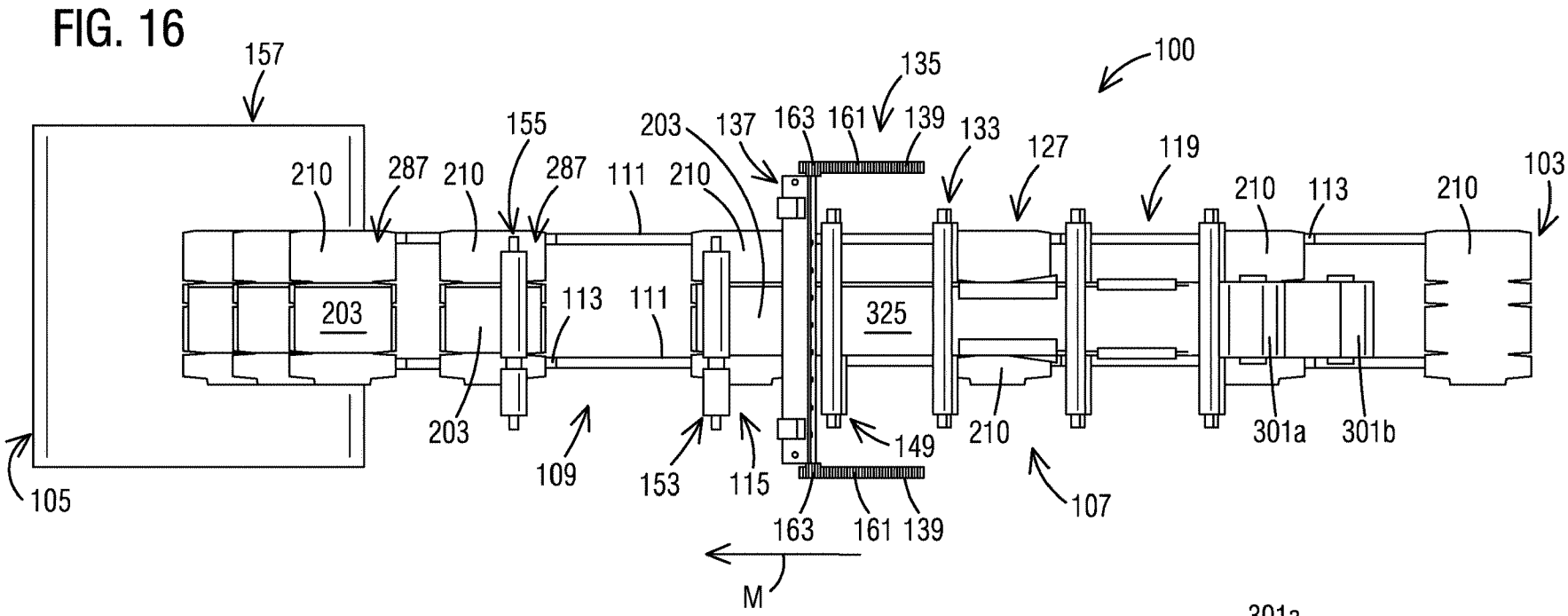
FIG. 16 is a plan view of the system of FIG. 15.
Figure 17:
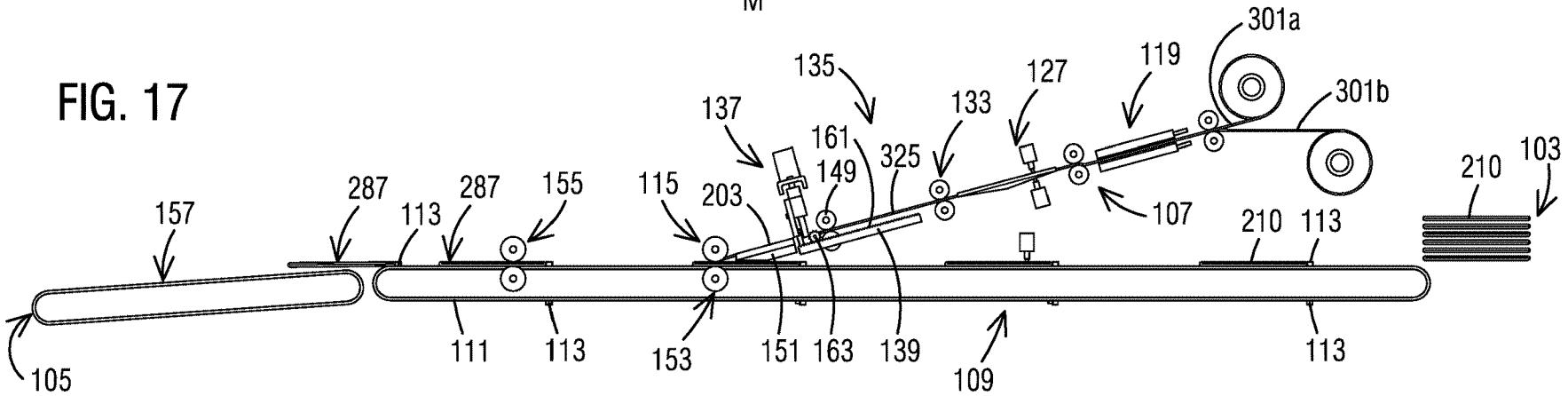
FIG. 17 is an elevation view of the system of FIGS. 15 and 16.

FIG. 12 is a plan view of a blank 210 for being combined with a liner 203 (FIG. 13) to form an attached blank 287 (FIG. 13) for forming a package 201 (FIG. 14), including a carton 205 and the liner 203, of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 12, the blank 210 is similar to the blank 10 of the first embodiment except that the blank 210 does not include the handles 65 or the tear feature 59. In addition, the blank 210 is smaller than the blank 10 of the first embodiment and the liner 203 is smaller than the liner 3 of the first embodiment in order to comport with the smaller blank 210. In one exemplary embodiment, the blank 10 can have overall dimensions of about 35.4 inches by about 54.5 inches and the liner 3 can have overall dimensions of about 31.1 inches by about 26.3 inches, while the blank 210 can have overall dimensions of about 16.7 inches by about 24.1 inches and the liner 203 can have overall dimensions of about 15.9 inches by about 24.0 inches. Accordingly, the system 100 is adjusted to accommodate the smaller blank 210 and liner 203 as illustrated in FIGS. 15-17. The blank 210 and/or the liner 203 could be otherwise shaped, arranged, configured, and/or positioned without departing from the disclosure.

As shown in FIGS. 15-17, the knife assembly 137 and the rollers 149 can be repositioned on the adjustable rack 139 so that the knife assembly 137 is closer to the nip rollers 153 (e.g., with respect to location of the knife assembly 137 in FIGS. 8-10) so that the distance between the cutting location of the knife blades 143, 145 is less than or equal to the height of the liner 203. In one embodiment, the liner guides 151 can be adjusted or replaced so that they only extend the shorter distance between the nip rollers 153 and the knife assembly 137. In the illustrated embodiment, the system 100 can move the blanks 110 on the blank conveyor 109, seal the webs 301*a*, 301*b* in the sealing station 119, form the hemmed edges 85 in the folding station 127, cut the tubular web 325 in the cutting station 135 to form the liner 203, and attach the liner 203 to the blank 210 to form the attached web 287 in the attachment station 115 similarly as described above with the blanks 10 and the liner 3.

The system 100 could be otherwise configured without departing from the scope of the disclosure. For example, the system 100 could be configured to form any suitable range of liner heights and widths and/or can be configured to accommodate blanks of any suitable size.

In one embodiment, a different system can form a liner by folding a single web (e.g., in a direction that is transverse to the machine direction) to form a tube and then sealing the tube to form a bag or other liner (e.g., see the incorporated-by-reference U.S. patent application Ser. No. 15/142,103).

However, such transverse folding is done gradually over a particular distance to reduce tearing or other defects in the liner that can occur if the folding is done over too short a distance. Accordingly, the larger the liner (e.g., the wider the liner is in the direction that is transverse to the machine direction), the folding system can be required to be longer to properly gradually fold the web. In exemplary embodiments, the system 100 can be advantageous in situations where a more compact (e.g., in the machine direction M) system is desired for a larger package and/or where the space is not available to accommodate the length required for a folding system to gradually fold a web to form a liner of a desired size. Stated another way, the system 100 forms a tubular liner by sealing two webs together so that the system can form large tubular liners without requiring an undesirable length that would be needed for forming the large liner by folding a single web. Another advantage of the system 100 according to exemplary embodiments is the adjustable cutting station 135 allows the system 100 to form liners having different heights (e.g., the L2 dimension in FIGS. 3 and 13). For example, the knife assembly 137 can be positioned on the adjustable rack 139 to form longer or shorter liners.

Generally, as described herein, bags can be formed from a paper stock material, although various plastic or other bag materials also can be used, and can be lined or coated with a desired material. The reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming attached blanks, the method comprising:

moving a blank in a machine direction on a blank conveyor;

forming a tubular web while moving a first web of material and a second web of material in the machine direction, the forming the tubular web comprising at least partially sealing at least a portion of the first web and the second web together to form a sealed margin of the tubular web;

forming a hem by folding the sealed margin into face-to-face contact with a surface of the tubular web after the forming the tubular web;

forming a liner by cutting the tubular web;

forming an attached blank by attaching the cut liner to the blank; and moving the attached blank in the machine direction on the blank conveyor.

2. The method of claim 1, wherein the forming the hem comprises gluing the sealed margin to the surface of the tubular web.

3. The method of claim 1, wherein the sealed margin is a first sealed margin, and the forming the tubular web further comprises at least partially sealing at least a portion of the first web and the second web together to form a second sealed margin.

4. The method of claim 3, wherein the hem is a first hem, and the method further comprises forming a second hem by folding the second sealed margin to overlap a second surface of the tubular web.

5. The method of claim 4, wherein the first surface and the second surface face away from one another.

6. The method of claim 4, wherein the forming the first hem comprises attaching the first sealed margin to the first surface and the forming the second hem comprises attaching the second sealed margin to the second surface.

7. The method of claim 1, wherein forming the liner comprises moving the tubular web through a knife assembly, the cutting the tubular web comprises actuating the knife assembly, and the knife assembly is mounted on an adjustable rack.

8. The method of claim 7, further comprising positioning the knife assembly on the adjustable rack in a direction that is parallel to the tubular web to set a height of the liner.

9. The method of claim 7, wherein the adjustable rack comprises a grooved top, the knife assembly comprises a pinion that engages the grooved top, and an interaction between the pinion and the grooved top facilitates adjustment of the position of the knife assembly in the machine direction.

10. The method of claim 7, wherein the adjustable rack is a first adjustable rack, the knife is mounted on the first adjustable rack via a first pinion and on a second adjustable rack via a second pinion, the first pinion engages a first grooved top of the first adjustable rack and the second pinion engages a second grooved top of the second adjustable rack.

11. The method of claim 7, wherein the knife assembly comprises a guillotine-style sheeter.

12. The method of claim 7, wherein the knife assembly comprises an first knife blade and a second knife blade, the cutting the tubular web comprising moving the tubular web between the first knife blade and the second knife blade and moving a first edge of the first knife blade past a second edge of the second knife blade to cut the tubular web between the first knife blade and the second knife blade.

13. The method of claim 12, wherein the first knife blade is an upper knife blade positioned above the tubular web, and the second knife blade is a base knife blade positioned below the tubular web.

14. The method of claim 7, wherein the attaching the liner to the blank comprises engaging the liner and the blank between a pair of nip rollers as the blank and the liner move in the machine direction, the pair of nip rollers is spaced from the knife assembly by a distance that is less than or equal to a height of the liner.

15. The method of claim 14, wherein the knife assembly is movable on the adjustable rack toward and away from the pair of nip rollers to adjust the height of the liner.

16. The method of claim 7, further comprising moving the tubular web on a liner guide that is disposed downstream from the knife assembly, the liner guide supporting the liner after the cutting the tubular web, wherein the liner guide is positioned above the blank and the blank conveyor.

17. The method of claim 1, wherein the attaching the liner to the blank comprises engaging the liner and the blank between a pair of nip rollers as the blank and the liner move in the machine direction after the cutting the tubular web.

18. A system for forming attached blanks, the system comprising:

a blank conveyor moving a blank in a machine direction to an attachment station;

a liner-forming assembly moving a first web and a second web in the machine direction, the liner-forming assembly comprising:

a sealing station forming the first web and the second web into a tubular web, the sealing station comprising a sealer that at least partially engages the first web and the second web to at least partially seal at least a portion of the first web and the second web together to form a sealed margin of the tubular web;

a folding station downstream from the sealing station, the folding station forming a hem in the tubular web by folding the sealed margin into face-to-face contact with a surface of the tubular web after the sealing station forms the tubular web;

a cutting station that receives the tubular web and comprises cutting features cutting the tubular web to form a liner; and an attachment station receiving the cut liner and the blank and attaching the cut liner to the blank to form an attached blank, the blank conveyor moving the attached blank in the machine direction.

19. The system of claim 18, wherein the folding station comprises a glue applicator that glues the sealed margin to the surface of the tubular web.

20. The system of claim 18, wherein the sealed margin is a first sealed margin, the sealer is a first sealer, and the sealing station further comprises a second sealer that at least partially engages the first web and the second web to at least partially seal at least a portion of the first web and the second web together to form a second sealed margin.

21. The system of claim 20, wherein the hem is a first hem and the surface of the tubular web is a first surface of the tubular web, the folding station comprising a first folder forming the first hem by folding the first sealed margin to overlap the first surface of the tubular web and a second folder forming a second hem by folding the second sealed margin to overlap a second surface of the tubular web.

22. The system of claim 21, wherein the first surface and the second surface face away from one another.

23. The system of claim 18, wherein the cutting features of the cutting station comprise a knife assembly receiving the tubular web, wherein the knife assembly is mounted on an adjustable rack, and the knife assembly is operable to cut the tubular web to form the liner.

24. The system of claim 23, wherein the knife assembly is positionable on the adjustable rack in a direction that is parallel to the tubular web for setting a height of the liner.

25. The system of claim 23, wherein the adjustable rack comprises a grooved top, the knife assembly comprises a pinion that engages the grooved top, and an interaction between the pinion and the grooved top facilitates adjustment of the position of the knife assembly in the machine direction.

26. The system of claim 23, wherein the adjustable rack is a first adjustable rack, the knife is mounted on the first adjustable rack via a first pinion and on a second adjustable rack via a second pinion, the first pinion engages a first grooved top of the first adjustable rack and the second pinion engages a second grooved top of the second adjustable rack.

27. The system of claim 23, wherein the knife assembly comprises a guillotine-style sheeter.

28. The system of claim 23, wherein the knife assembly comprises a first knife blade having a first edge and a second knife blade having a second edge, the first edge being movable toward the second edge for cutting the tubular web between the first knife blade and the second knife blade.

29. The system of claim 28, wherein the first knife blade is an upper knife blade positioned above the tubular web, and the second knife blade is a base knife blade positioned below the tubular web.

30. The system of claim 23, wherein the attachment station comprises a pair of nip rollers engaging the liner and the blank therebetween as the blank and the liner move in the machine direction, the pair of nip rollers is spaced from the knife assembly by a distance that is less than or equal to a height of the liner.

31. The system of claim 30, wherein the knife assembly is movable on the adjustable rack toward and away from the pair of nip rollers to adjust the height of the liner.

32. The system of claim 23, further comprising a liner guide extending between the knife assembly and the attachment station, the liner guide supporting the liner downstream from the knife assembly, wherein the liner guide is positioned above the blank and the blank conveyor.

33. The system of claim 18, wherein the attachment station comprises a pair of nip rollers engaging the liner and the blank therebetween as the blank and the liner move in the machine direction, the pair of nip rollers being downstream from the cutting station.

* * * * *